US009863617B2

(12) United States Patent
Hirano

(10) Patent No.: US 9,863,617 B2
(45) Date of Patent: Jan. 9, 2018

(54) LIGHT EMITTING MODULE AND ILLUMINATING INSTRUMENT USING SAME

(71) Applicant: PANASONIC INTELLECTUAL PROPERTY MANAGEMENT CO., LTD., Osaka (JP)

(72) Inventor: Akihiro Hirano, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 285 days.

(21) Appl. No.: 14/766,209

(22) PCT Filed: Nov. 28, 2013

(86) PCT No.: PCT/JP2013/006998
§ 371 (c)(1),
(2) Date: Aug. 6, 2015

(87) PCT Pub. No.: WO2014/125537
PCT Pub. Date: Aug. 21, 2014

(65) Prior Publication Data

US 2015/0369463 A1 Dec. 24, 2015

(30) Foreign Application Priority Data

Feb. 13, 2013 (JP) ..... 2013-025998
Jul. 18, 2013 (JP) ..... 2013-149716

(51) Int. Cl.
*F21V 21/088* (2006.01)
*F21V 19/00* (2006.01)
(Continued)

(52) U.S. Cl.
CPC ..... *F21V 21/02* (2013.01); *F21K 9/20* (2016.08); *F21V 19/003* (2013.01);
(Continued)

(58) Field of Classification Search
CPC ..... F21V 21/02; F21V 9/20; F21V 19/003; F21V 19/008
See application file for complete search history.

(56) References Cited

U.S. PATENT DOCUMENTS 8,596,837 B1 * 12/2013 Wronski ..... F21V 29/004 362/249.02
2013/0265783 A1 * 10/2013 Wang ..... F21V 29/006 362/374
2013/0329438 A1 12/2013 Wakahara et al.

FOREIGN PATENT DOCUMENTS

EP 2495491 9/2012
EP 2495492 9/2012
(Continued)

OTHER PUBLICATIONS

International Search Report issued in PCT/JP2013/006998, dated Jan. 28, 2014.

*Primary Examiner* — Anh Mai
*Assistant Examiner* — Nathaniel Lee
(74) *Attorney, Agent, or Firm* — Greenblum & Bernstein, P.L.C.

(57) ABSTRACT

The light source unit has holding portions for holding a socket on a mounting surface facing the socket, and the socket has an engagement portion for engagement with holding portions. The engagement portion has engagement claws biased in parallel to the mounting surface movably oppositely to each other and engaged with the holding portions, and a holding mechanism that holds the engagement claws while they are adjacent to each other so as not to be engaged with the holding portions. The engagement claws and the holding portions are engaged with each other when the light source unit is disposed in the mounting position to the socket, and the engagement claws held by the holding mechanism is released. For this reason, it is possible
(Continued)

to install the light source unit to the socket with a weak force.

17 Claims, 21 Drawing Sheets

(51) Int. Cl.

| | |
|---|---|
| ***F21V 21/02*** | (2006.01) |
| ***F21K 9/20*** | (2016.01) |
| *F21Y 105/00* | (2016.01) |
| *F21Y 115/15* | (2016.01) |

(52) U.S. Cl.
CPC ..... *F21V 19/008* (2013.01); *F21Y 2105/00* (2013.01); *F21Y 2115/15* (2016.08)

(56) References Cited

FOREIGN PATENT DOCUMENTS

| | | |
|---|---|---|
| JP | 2011-243461 | 12/2011 |
| WO | 2012/114887 | 8/2012 |
| WO | 2012/120739 | 9/2012 |

* cited by examiner

Lock State

Set State

Set State

Set State

Lock State

Set State

LIGHT EMITTING MODULE AND ILLUMINATING INSTRUMENT USING SAME

TECHNICAL FIELD

The present invention relates to a light emitting module having an organic electroluminescent (EL) element as a light source and an illuminating instrument using the same.

BACKGROUND ART

Using an organic electroluminescent (EL) element, light can be emitted with high luminance at a low voltage, and various light colors can be obtained depending on types of organic compounds contained therein. In addition, a light emitting flat panel can be easily manufactured using the organic EL element. In recent years, the organic EL element has been highlighted as a light source of a light emitting module.

As illustrated in FIG. 21, there is known a light emitting module 100 including a rectangular flat light source unit 20 having such an organic EL element 10 as a light source and a socket 30 where the light source unit 20 is mounted detachably (for example, see Patent Literature 1). The socket 30 includes a rectangular hollow 40 where the light source unit 20 is fitted, and an engagement claw 50 provided in an inner circumference of the hollow 40 and elastically biased by a spring (not shown) inward of the light emitting module 100. The light source unit 20 has a holding portion 60 engaged with the engagement claw 50 in a position matching the engagement claw 50 on its side surface and is pivotably installed in the socket 30 with respect to a side facing that of the holding portion 60.

As the light source unit 20 is pivoted to the socket 30, the light source unit 20 abuts on the engagement claw 50 of the socket 30. As the light source unit 20 is further forced toward the socket 30 from this state, the engagement claw 50 slides toward the outside of the light emitting module 100 resisting to a biasing force of the spring, so that the light source unit 20 is fitted to the hollow 40. Then, the engagement claw 50 is elastically biased again toward the inside of the light emitting module 100 by the spring and is engaged with the holding portion 60 of the light source unit 20. In this way, the light source unit 20 is mounted to the socket 30.

CITATION LIST

Patent Literatures

[Patent Literature 1] JP 2011-243461 A

SUMMARY OF INVENTION

However, since the socket 30 is larger than the light source unit 20 in the light emitting module 100 described above, a portion of the socket 30 serving as a non-luminescent face disadvantageously increases, and a portion of the luminescent face decreases, for example, when a plurality of light emitting modules 100 are arranged in a matrix shape.

In this regard, in order to increase a portion of the luminescent face, it is conceived that the socket may be formed to be smaller than the light source unit, and the socket may be arranged in a rear side of the light source unit. In this case, since the large light source unit is held by the small socket, it is necessary to allow the socket to elastically bias the engagement claws with a strong pressure in order to prevent dropping of the light source unit. Accordingly, a strong force is necessary when the light source unit is installed to the socket. In particular, when the luminescent face of the light source unit is large, a user may press the luminescent face of the light source unit in some cases. If the luminescent face is externally pressed, the organic EL element may be damaged, and this may degrade light emitting performance.

In view of the aforementioned problems, it is therefore an object of this invention to provide a light emitting module capable of reliably preventing the light source unit from dropping from the socket and installing the light source unit to the socket with a weak force.

According to an aspect of the present invention, there is provided a light emitting module comprising: a flat light source unit; and a flat socket where the light source unit is detachably mounted, any one of the light source unit and the socket having a holding portion for holding the other one in a center of a mounting surface facing the other one, the other one having an engagement portion for engagement with the holding portion, the engagement portion having a pair of engagement claws biased in parallel to the mounting surface movably oppositely to each other and engaged with the holding portion, and a holding mechanism that holds the pair of engagement claws resisting to a biasing force so as to prevent the pair of engagement claws from being engaged with the holding portion, the light source unit being disposed in a mounting position to the socket so that the pair of engagement claws and the holding portion are engaged with each other when the pair of engagement claws held by the holding mechanism are released.

Preferably, the holding portion has a release portion that releases the pair of engagement claws held by the holding mechanism when the light source unit is disposed in the mounting position to the socket.

Preferably, the release portion releases the pair of engagement claws held by the holding mechanism when the light source unit and the socket approach each other by causing corresponding mounting surfaces to face each other, and the light source unit is disposed in the mounting position to the socket.

Preferably, a plurality of the release portions are erected on the mounting surface, at least one of the release portions releases one of the pair of engagement claws held by the holding mechanism, and the other release portion releases the other engagement claw held by the holding mechanism.

Preferably, each of the pair of engagement claws is movable in an intersecting direction intersecting with a corresponding biasing direction in parallel to the mounting surface, and the holding mechanism holds the pair of engagement claws by moving the pair of engagement claws in the intersecting direction.

Preferably, the holding mechanism has a pair of protrusions extending from the pair of engagement claws, respectively, perpendicularly to the mounting surface, a pair of paralleled trenches provided in parallel to the biasing direction to receive the pair of protrusions when they are inserted, respectively, and a pair of intersecting trenches provided to connect with inward ends of the pair of paralleled trenches, respectively, in the light emitting module and extend along the intersecting direction.

Preferably, the pair of protrusions are arranged in a point symmetrical manner with respect to a center of the light emitting module such that the pair of engagement claws are held by the holding mechanism when the pair of protrusions move oppositely to each other.

Preferably, the release portions abut on ends of the intersecting direction of the pair of engagement claws held by the holding mechanism when the light source unit is disposed in the mounting position to the socket, and surfaces of the release portions abutting on the pair of engagement claws from a basal portion to an apex portion have a tapered shape such that they are inclined from an inward side to an outward side of the light emitting module.

Preferably, each of the pair of engagement claws is movable in parallel to the mounting surface and the corresponding biasing direction, and the holding mechanism holds the pair of engagement claws while the pair of engagement claws are adjacent to each other.

Preferably, the holding mechanism has a pair of protrusions extending from the pair of engagement claws, respectively, perpendicularly to the mounting surface, a pair of paralleled trenches provided in parallel to the biasing direction to receive the pair of protrusions, respectively, when they are inserted, an elastic extension extending from each of the pair of engagement claws in parallel to the pair of paralleled trenches, a hooking claw protruding from the basal portion of the extension toward the mounting surface, and a hooking concave portion engaged with the hooking claw while the pair of engagement claws are adjacent to each other.

Preferably, the release portion presses an end of the extension oppositely to the mounting surface to release engagement between the hooking claw and the hooking concave portion when the light source unit is disposed in the mounting position to the socket while the pair of engagement claws are adjacent to each other using the holding mechanism.

Preferably, the holding mechanism further has a housing concave portion for housing the hooking claw, the housing concave portion being arranged outward more than the hooking concave portion in the light emitting module along the biasing direction, and the housing concave portion houses the hooking claw when engagement between the hooking claw and the hooking concave portion is released.

Preferably, the engagement portion has a mark indicating a holding state of the pair of engagement claws held by the holding mechanism, the mark is exposed to the mounting surface side when the holding mechanism holds the pair of engagement claws, and the mark is concealed by the pair of engagement claws so as not to be exposed to the mounting surface side when the pair of engagement claws held by the holding mechanism is released.

Preferably, the socket has a plurality of socket fixtures where screws for fixing the socket to an application surface are inserted, and one of the plurality of socket fixtures is provided in the center of the mounting surface.

Preferably, each of the pair of engagement claws has convex or concave portions having different numbers or relative positions, and the holding portion has concave or convex portions fitted to the convex or concave portions of the engagement claws.

Preferably, the light source unit has a pair of feeding terminals for feeding the light source unit on the mounting surface, the socket has a pair of terminal receptacles for receiving the pair of feeding terminals, respectively, and the pair of feeding terminals are electrically connected to the pair of terminal receptacles, respectively, when the light source unit is mounted to the socket.

According to another aspect of the present invention, there is provided an illuminating instrument comprising the light emitting module described above.

According to the present invention, the engagement claws and the holding portions are engaged with each other by disposing the light source unit in the mounting position to the socket and then releasing the holding mechanism while the engagement claws are not engaged with the holding portion using the holding mechanism. For this reason, it is possible to reliably prevent the light source unit from dropping from the socket and install the light source unit to the socket with a weak force.

DESCRIPTION OF EMBODIMENTS

Figure 1:
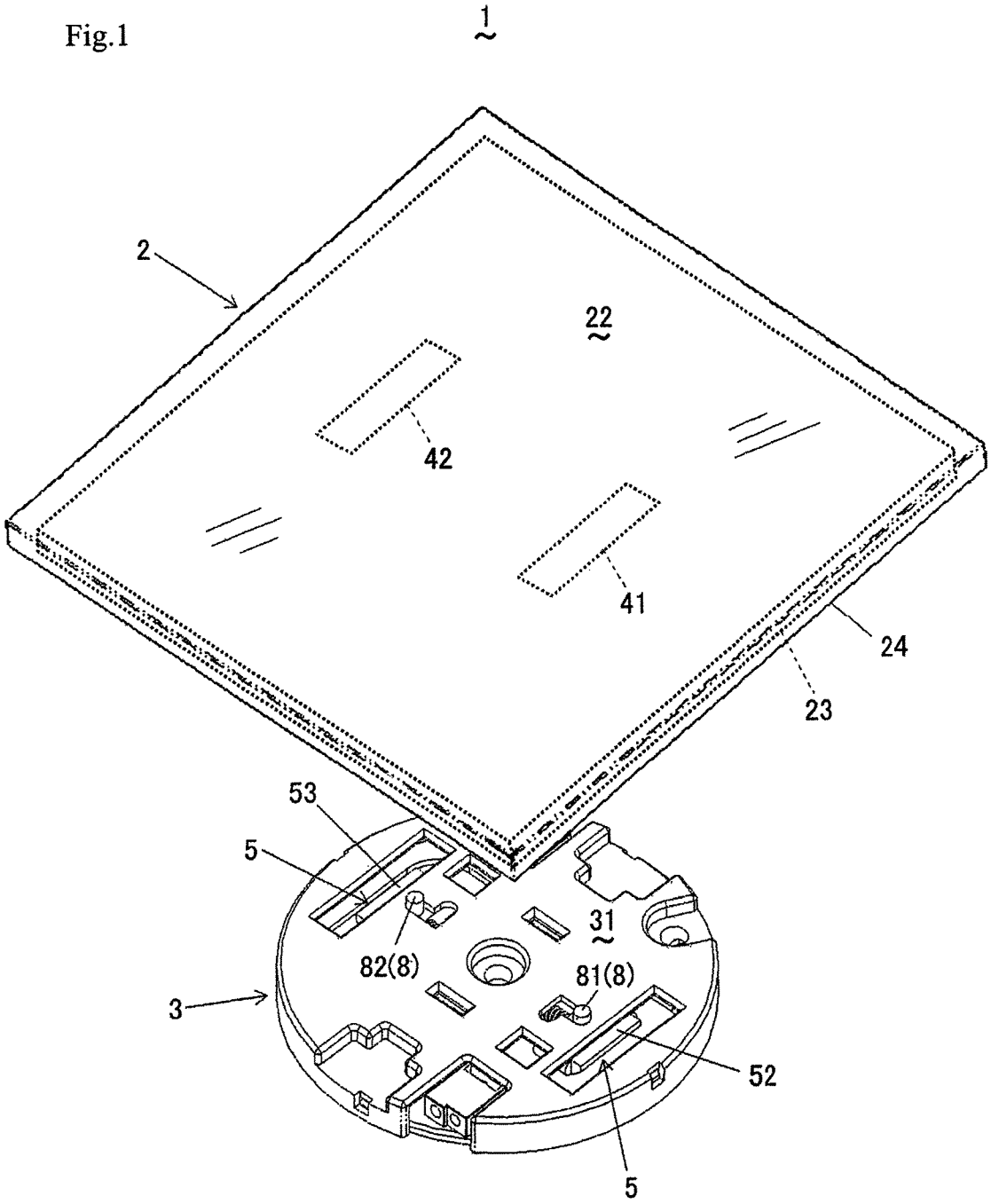
FIG. 1 is an exploded perspective view illustrating a light emitting module according to a first embodiment of the present invention as seen from a light source unit side.
Figure 2:
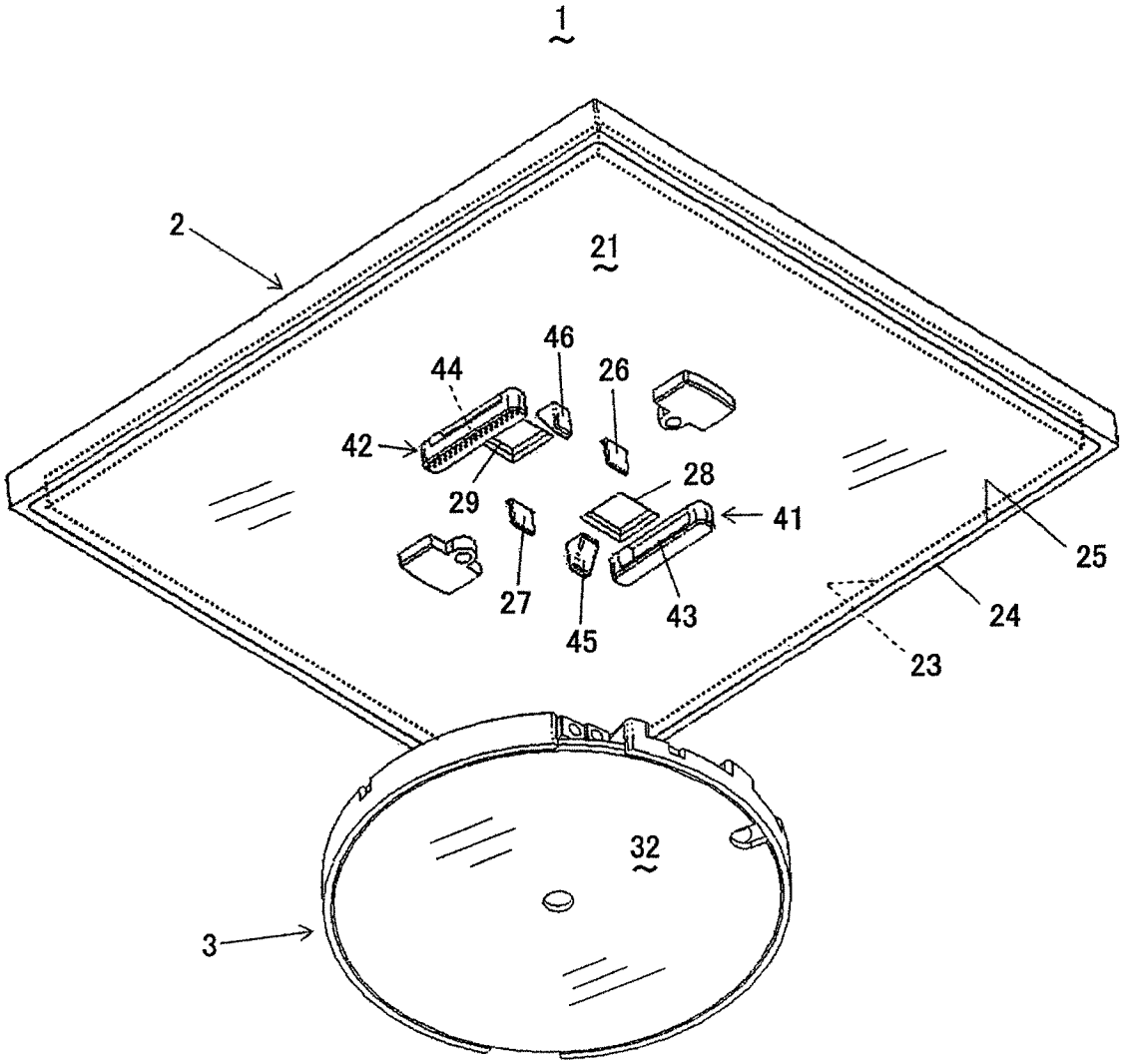
FIG. 2 is an exploded perspective view illustrating the light emitting module as seen from the socket side.

A description will now be made for a light emitting module as one of configurations of an illuminating instrument according to a first embodiment of the present invention with reference to FIGS. 1 to 8. As illustrated in FIGS. 1 and 2, the light emitting module 1 comprises a light source unit 2 and a socket 3 where the light source unit 2 is detachably mounted.

The light source unit 2 has a rectangular flat shape. A surface facing the socket 3 serves as a mounting surface 21 used in engagement with the socket 3, and the other surface serves as a light irradiation surface 22. The light source unit 2 comprises a rectangular light emitting flat panel 23 having an organic EL element as a light source, a transparent front cover 24 that covers the luminescent face of the light emitting panel 23, and a rear cover 25 engaged with the front cover 24 to cover the surface opposite to the luminescent face of the light emitting panel 23.

A pair of holding portions 41 and 42 used in engagement with the socket 3 is provided in the center of the rear cover 25 (mounting surface 21) (refer to FIG. 2). The holding portions 41 and 42 have holding claws 43 and 44 engaged with the engagement claws 52 and 53 of the socket 3 (which will be described below), and release portions 45 and 46 erected on the mounting surface 21 and used to release the engagement claws 52 and 53 (which will be described below), respectively. In addition, the light source unit 2 has, on its mounting surface 21, a pair of feeding terminals 26 and 27 used to feed the light source unit 2, and loosening portions 28 and 29 for loosening protrusions 81 and 82 of the holding mechanism 8 described below.

Figure 3:
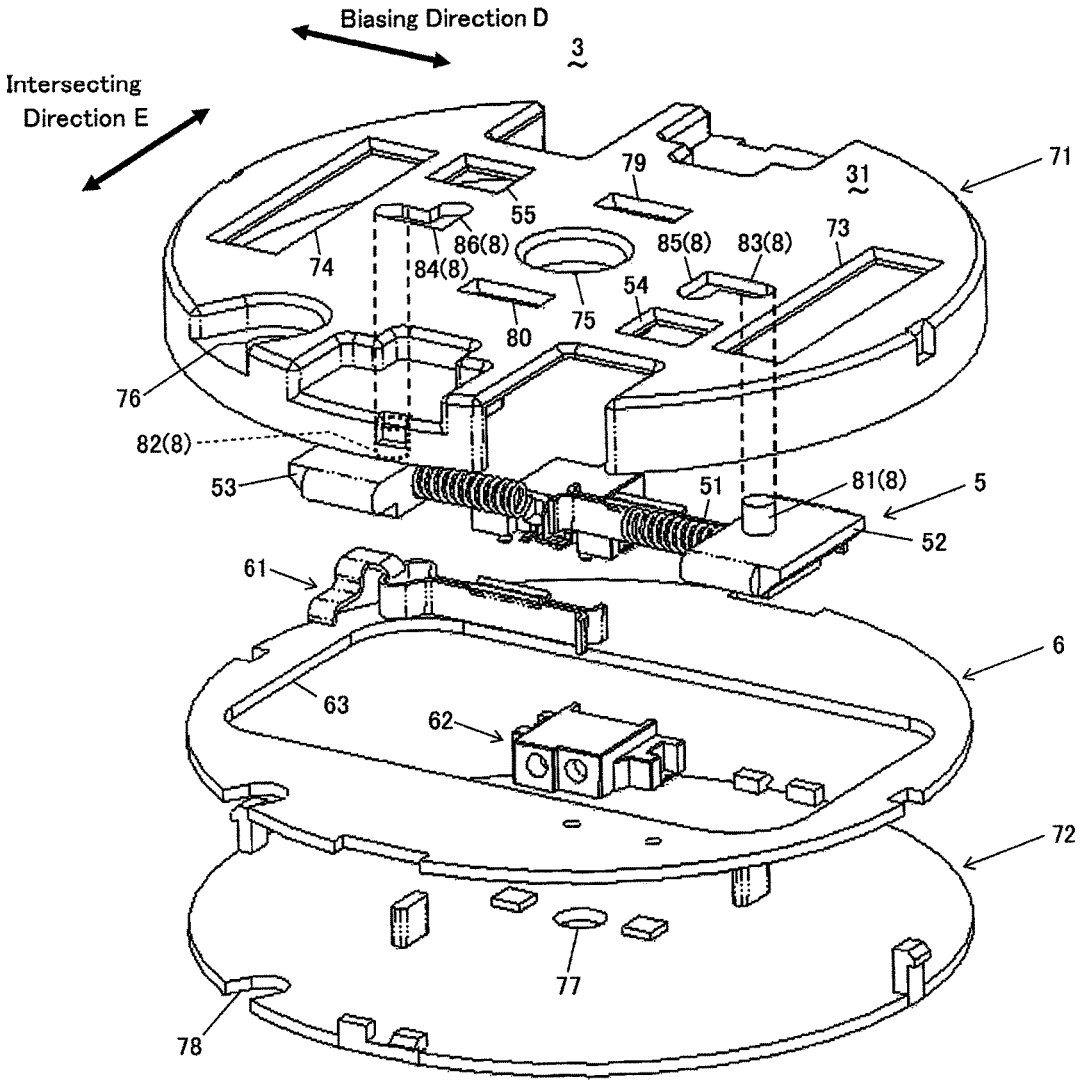
FIG. 3 is an exploded perspective view illustrating the socket.

The socket 3 has a disc shape. A surface facing the light source unit 2 serves as a mounting surface 31 where the light source unit 2 is mounted, and the other surface serves as an installation surface 32 installed to an application surface such as a ceiling or a wall. As illustrated in FIG. 3, the socket 3 has an engagement portion 5 used in engagement with the holding portions 41 and 42 of the light source unit 2. In addition, the socket 3 has a circuit board 6 that controls feeding to the light source unit 2, a socket body 71 having a flat bottomed cylindrical shape and housing the engagement portion 5 and the circuit board 6, and a socket cover 72 that encapsulates an opening of the socket body 71. The surface of the socket body 71 serves as the mounting surface 31.

The engagement portion 5 has a spring 51 arranged in parallel to the mounting surface 31 and a pair of engagement claws 52 and 53 provided in ends of the spring 51 and engaged with the holding claws 43 and 44, respectively, of the light source unit 2. As a result, the engagement claws 52 and 53 are elastically biased so as to move oppositely to each other in parallel to the mounting surface 31. It is noted that an elastically biased direction of the spring 51 will be referred to as a biasing direction D, hereinafter.

The engagement portion 5 has a holding mechanism 8 that holds the engagement claws 52 and 53 adjacently to each other resisting to a biasing force caused by the spring 51 so as not to engage the engagement claws 52 and 53 with the holding claws 43 and 44. The holding mechanism 8 has a pair of protrusions 81 and 82 extending from the engagement claws 52 and 53, respectively, toward the socket body 71 perpendicularly to the mounting surface 31, and a pair of paralleled trenches 83 and 84 provided on the mounting surface 31 in parallel to the biasing direction D to receive the inserted protrusions 81 and 82, respectively. The protrusions 81 and 82 are arranged in a point symmetrical manner to each other with respect to the center of the light emitting module 1 (or the socket 3). In addition, the holding mechanism 8 has a pair of intersecting trenches 85 and 86 arranged to connect with inward ends of the paralleled trenches 83 and 84, respectively, in the light emitting module 1 and extend in a direction intersecting with the biasing direction D (hereinafter, referred to as an intersecting direction E) on the mounting surface 31. In the illustrated example, the intersecting trenches 85 and 86 are provided perpendicularly to the biasing direction D on the mounting surface 31 to extend oppositely to each other. In this configuration, the engagement claws 52 and 53 can move in both the biasing direction D and the intersecting direction E in parallel to the mounting surface 31 within a range of the movement of the protrusions 81 and 82 along both the paralleled trenches 83 and 84 and the intersecting trenches 85 and 86.

The engagement portion 5 has a pair of slots 54 and 55 provided in the socket body 71 adjacently to the ends of the intersecting direction E sides of the intersecting trenches 85 and 86. The release portions 45 and 46 of the holding portions 41 and 42 described above are inserted into the slots 54 and 55, respectively, when the light source unit 2 is disposed in the mounting position to the socket 3. The release portions 45 and 46 inserted to the slots 54 and 55, respectively, abut on the engagement claws 52 and 53, respectively, held by the holding mechanism 8 as described below to release the engagement claws 52 and 53 held by the holding mechanism 8.

The socket body 71 has holes 73 and 74 where the holding portions 41 and 42 of the light source unit 2 are fitted and socket fixtures 75 and 76 where screws (not shown) for fixing the socket 3 to the application surface are inserted. The socket fixture 75 is provided in the center of the mounting surface 31. The socket cover 72 has the socket fixtures 77 and 78 positioned to match the socket fixtures 75 and 76, respectively.

In order to fix the socket 3 to the application surface, first, the screws are inserted into the socket fixtures 75 and 77 to mount the socket 3 to the application surface using screws. In this case, since the socket fixtures 75 and 77 are provided in the center of the mounting surface 31, a relative position of the socket 3 does not change even when the orientation of the socket 3 is adjusted by rotating the socket 3 in this state. It is possible to reliably install the socket 3 in a predetermined place and a predetermined orientation by further fixing the socket 3 on the application surface using screws by interposing the socket fixtures 76 and 78 after changing the orientation of the socket 3.

The socket body 71 has a pair of terminal slots 79 and 80 where the feeding terminals 26 and 27 of the light source unit 2 are inserted. The circuit board 6 has a terminal receptacle 61 for receiving the feeding terminals 26 and 27 inserted into the terminals slots 79 and 80 and a connector 62 connected to an external power supply. The electric power supplied from the external power supply is electrically transmitted to the light source unit 2 via the connector 62, the circuit board 6, the terminal receptacle 61, and the feeding terminals 26 and 27. The feeding terminals 26 and 27 are configured to electrically connect with the terminal receptacle 61 as the light source unit 2 is mounted to the socket 3. In this manner, since both the mounting of the light source unit 2 to the socket 3 and the electrical connection between the feeding terminals 26 and 27 and the terminal receptacle 61 can be performed simultaneously, it is possible to improve operability. It is noted that, although only a single terminal receptacle 61 and only a single connector 62 are illustrated in FIG. 3 for simplicity purposes, a pair of terminal receptacles 61 and a pair of connectors 62 are provided to match the feeding terminals 26 and 27, respectively, in practice.

The circuit board 6 has a cutaway part 63 in its center, and the engagement portion 5 is housed in the cutaway part 63. In this manner, it is possible to reduce a thickness of the socket 3, compared to a case where the engagement portion 5 is disposed on the circuit board 6 without such a cutaway part.

Figure 4B:
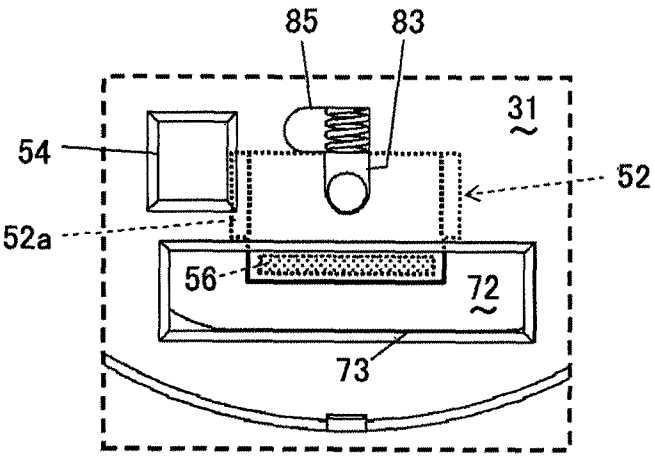
FIG. 4B is a plan view illustrating an area enveloped by the dotted line of FIG. 4A.
Figure 4A:
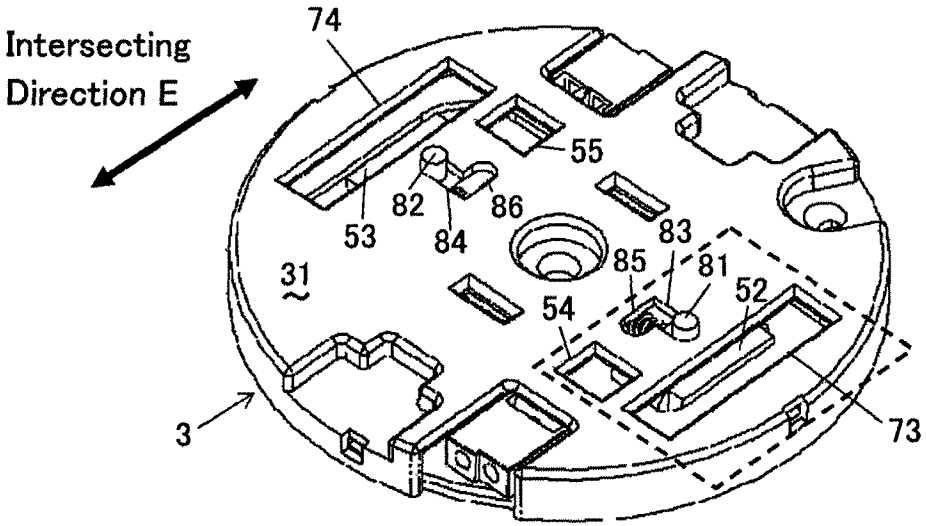
FIG. 4A is a perspective view illustrating an engagement portion in a locked state in the socket.

If the protrusions 81 and 82 abut on outward ends of the paralleled trenches 83 and 84 in the socket 3 as illustrated in FIG. 4A, the engagement claws 52 and 53 are placed directly under the holes 73 and 74 and are positioned in a "locked state" in which the engagement claws 52 and 53 can be engaged with the holding claws 43 and 44 of the light source unit 2. As illustrated in FIG. 4B, a mark 56 (indicated by dots), for example, formed by coating a paint having a conspicuous color is provided in an area of the socket cover 72 concealed by the engagement claw 52 placed directly under the hole 73 in the locked state.

Figure 5B:
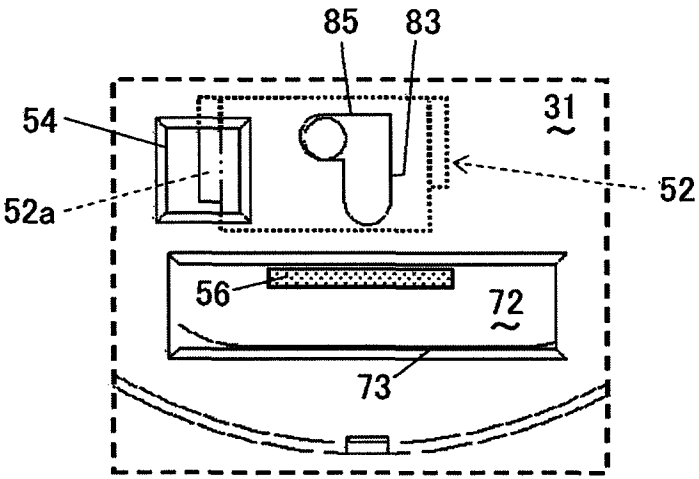
FIG. 5B is a plan view illustrating an area enveloped by the dotted line of FIG. 5A.
Figure 5A:
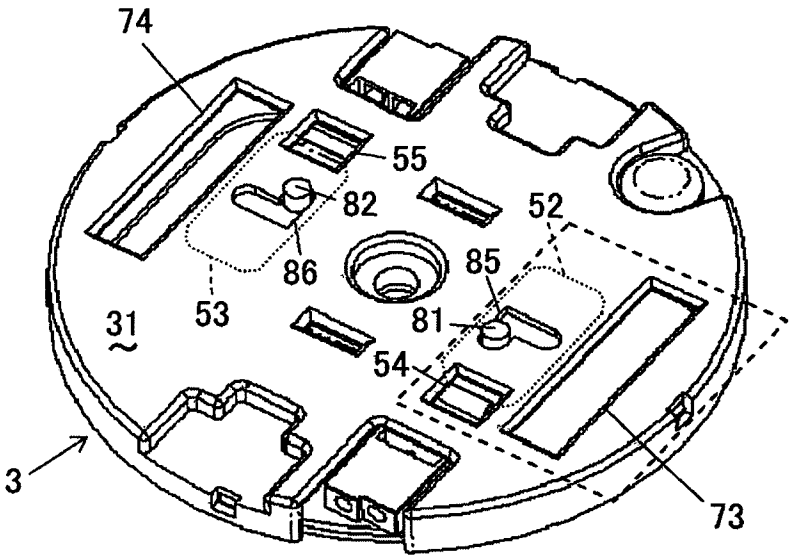
FIG. 5A is a perspective view illustrating an engagement portion in a set state in the socket.

From this state, the protrusions 81 and 82 are locked to the intersecting trenches 85 and 86 by gripping and moving the protrusions 81 and 82 inward in the socket 3 resisting to an elastic force of the spring 51 and then moving the protrusions 81 and 82 along the intersecting direction E oppositely to each other so as to be displaced relatively. As a result, as illustrated in FIG. 5A, the engagement claws 52 and 53 are positioned in a "set state" in which the engagement claws 52 and 53 are held adjacently to each other. In this set state, it is difficult to engage the engagement claws 52 and 53 with the holding claws 43 and 44 of the light source unit 2 since they are not exposed externally from the holes 73 and 74 because they are placed inward more than the holes 73 and 74 in the socket 3. In this case, as illustrated in FIG. 5B, the mark 56 is not concealed by the engagement claw 52, and is exposed externally from the hole 73 as seen from the mounting surface 31 side so that it can be easily recognized by a user. That is, the mark 56 indicates a holding state of the engagement claw 52 caused by the holding mechanism 8. When the engagement claw 52 has the set state, it is exposed to the mounting surface 31 side. When the engagement claw 52 has the locked state, the mark is concealed by the engagement claw 52 and is not exposed to the mounting surface 31 side. By providing such a mark 56, a user can easily recognize whether or not the engagement claw 52 has the locked state or the set state. It is noted that, although not illustrated, the mark 56 is also provided in an area of the socket cover 72 matching the engagement claw 53.

The slot 54 is provided such that an end 52*a* of the engagement claw 52 in an extending direction of the intersecting trench 85 is not exposed externally in the locked state as seen from the mounting surface 31 side (refer to FIG. 4B), and it is exposed externally in the set state (refer to FIG. 5B). It is noted that the slot 55 is also configured similarly to the slot 54.

Figure 6:
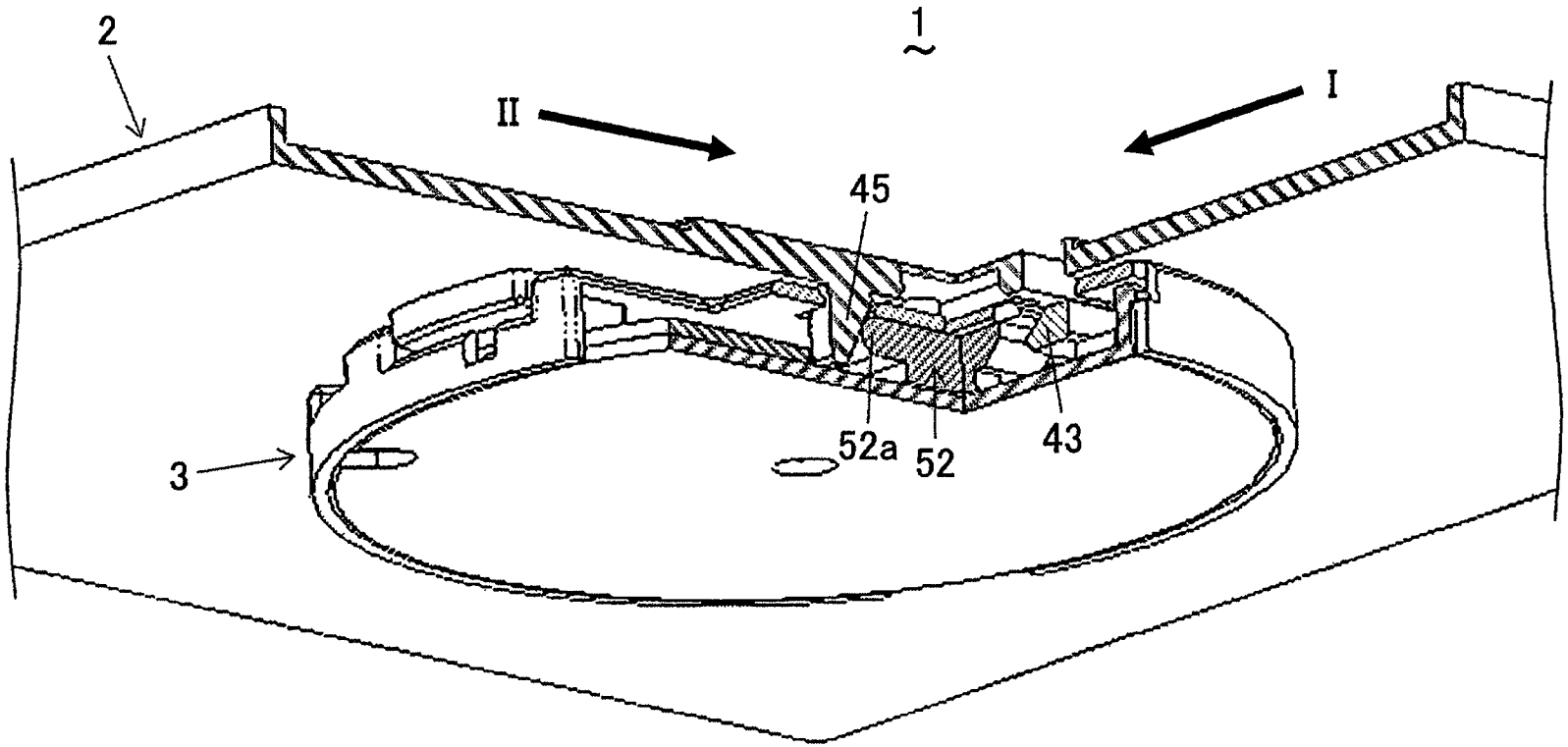
FIG. 6 is a partially cross-sectional view illustrating engagement between the light source unit and the socket.
Figure 7A:
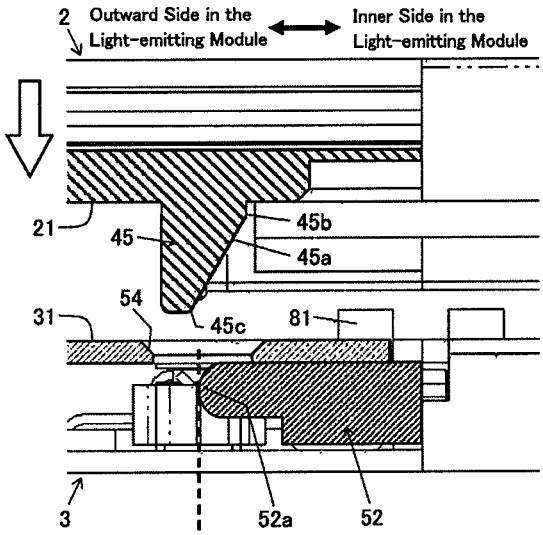
FIGS. 7A, 7C, and 7E are cross-sectional views illustrating a procedure of engaging the light source unit and the socket as seen from the direction I of FIG. 6.

A description will now be made, with reference to FIGS. 6 to 8, for operation of the light emitting module 1 configured as described above when the light source unit 2 is mounted to the socket 3. FIGS. 7A, 7C, and 7E illustrate a state that the release portion 45 abuts on the end 52*a* of the engagement claw 52 from a direction I of FIG. 6. FIGS. 8A and 8B illustrate a state that the engagement claw 52 and the holding claw 43 are engaged with each other from a direction II of FIG. 6.

Figure 7B:
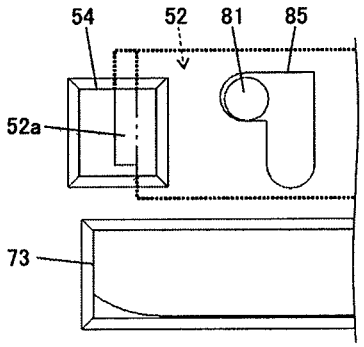
FIGS. 7B, 7D, and 7F are diagrams illustrating the state of FIGS. 7A, 7C, and 7E as seen from a mounting surface of the socket.
Figure 7C:
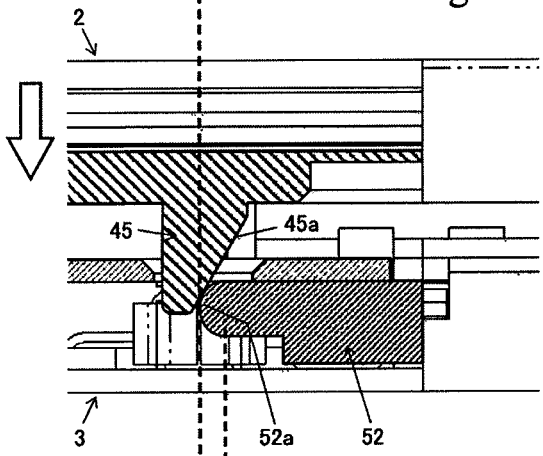
Figure 7D:
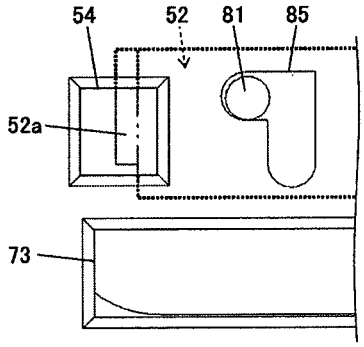
Figure 7E:
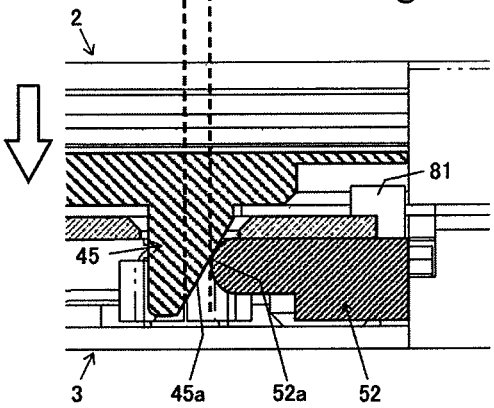
Figure 7F:
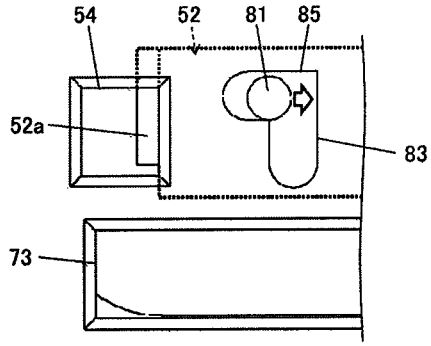
Figure 8B:
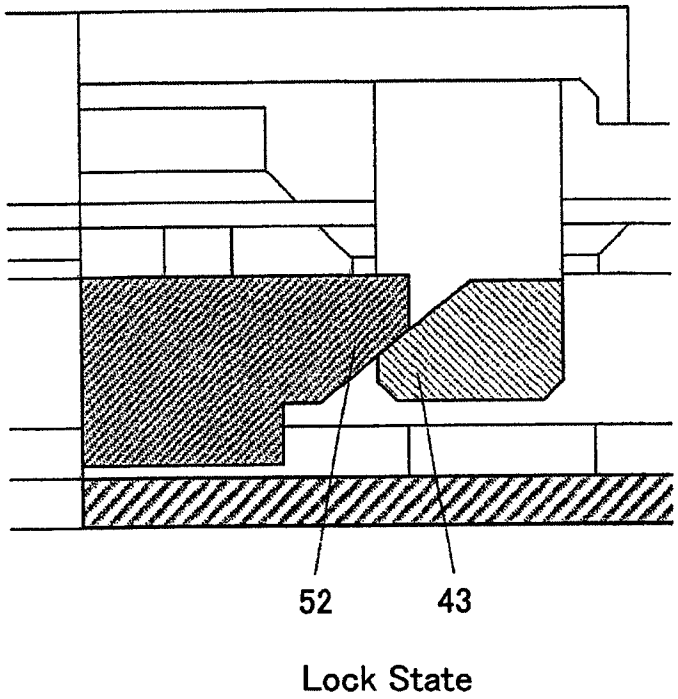
FIGS. 8A and 8B are cross-sectional views illustrating a procedure of engaging the light source unit and the socket as seen from the direction II of FIG. 6.
Figure 8A:
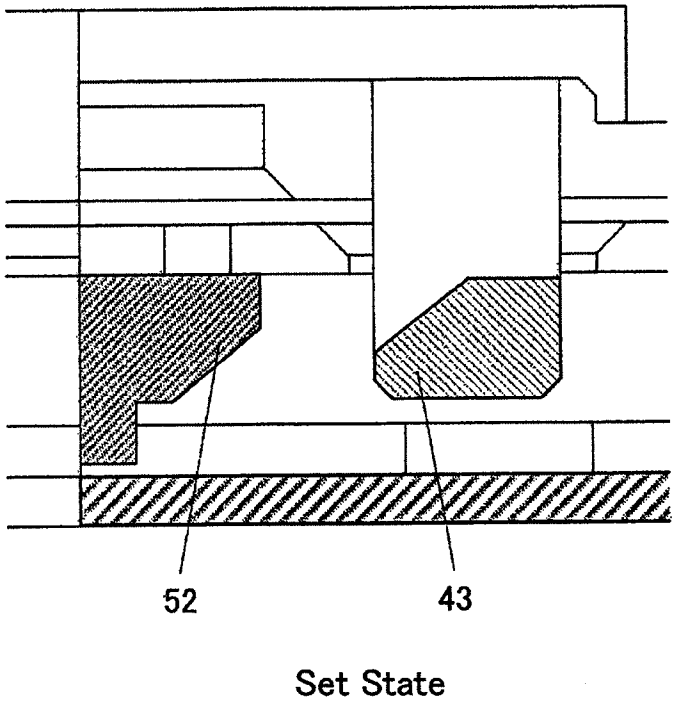

As illustrated in FIGS. 7A and 7B, in order to mount the light source unit 2 to the socket 3, first, the engagement claw 52 is positioned in the set state by locking the protrusion 81 to the intersecting trench 85. In addition, in this state, the light source unit 2 and the socket 3 approach each other to face the mounting surfaces 21 and 31, respectively, such that the release portion 45 of the light source unit 2 is inserted into the slot 54 of the socket 3. Here, the release portion 45 is formed in a tapered shape such that the surface 45*a* abutting on the end 52*a* of the engagement claw 52 from the basal portion 45*b* to the apex portion 45*c* is inclined from the inward side to the outward side in the light emitting module 1. Then, as illustrated in FIGS. 7C and 7D, the light source unit 2 is inserted into the socket 3 until the surface 45*a* of the release portion 45 abuts on the end 52*a* of the engagement claw 52. As the light source unit 2 is further inserted into the socket 3 as illustrated in FIGS. 7E and 7F from this state, the end 52*a* of the engagement claw 52 is pressed by the surface 45*a* of the release portion 45, and the engagement claw 52 slides, so that the protrusion 81 moves from the intersecting trench 85 to the paralleled trench 83. In this manner, a force of inserting the light source unit 2 to the socket 3 is converted into a force of moving the protrusion 81 from the intersecting trench 85 to the paralleled trench 83 by causing the release portion 45 and the engagement claw 52 to abut on each other. It is noted that an unintended movement of the protrusion 81 from the intersecting trench 85 to the paralleled trench 83 may be prevented by forming the intersecting trench 85 at an acute angle to the paralleled trench 83.

When the protrusion 81 is locked to the intersecting trench 85, the engagement claw 52 is not engaged with the holding claw 43 in the set state as illustrated in FIG. 8A. As the protrusion 81 moves from the intersecting trench 85 to the paralleled trench 83 from this state as described above, the engagement claw 52 is elastically biased to the holding claw 43 and is engaged with the holding claw 43 so as to have the locked state as illustrated in FIG. 8B. In this manner, when the light source unit 2 is disposed in the mounting position to the socket 3, the release portion 45 engages the engagement claw 52 and the holding claw 43 with each other by releasing the engagement claw 52 held by the holding mechanism 8. It is noted that releasing of the engagement claw 53 using the release portion 46 is similar to releasing of the engagement claw 52 using the release portion 45 described above.

As described above, in the light emitting module 1 according to this embodiment, while the engagement claws 52 and 53 are not engaged with the holding claws 43 and 44 using the holding mechanism 8, the light source unit 2 is disposed in the mounting position to the socket 3, and the holding mechanism 8 is then released, so that the claws are engaged with each other. For this reason, it is possible to reliably prevent dropping of the light source unit 2 from the socket 3 and install the light source unit 2 to the socket 3 with a weak force. As a result, it is possible to prevent a user from trying to mounting the light source unit 2 to the socket 3 by erroneously pressing the light irradiation surface 22 of the light source unit 2, for example, even when a size of the light source unit 2 is large. Therefore, it is possible to prevent a damage of the light emitting panel 23. It is noted that the light source unit 2 is removed from the socket 3 by pulling and separating the light source unit 2 from the socket 3 and compressing the spring 51 so as to release engagement between the holding claws 43 and 44 and the engagement claws 52 and 53.

Since the release portions 45 and 46 release the engagement claws 52 and 53 held by the holding mechanism 8 just by disposing the light source unit 2 in the mounting position to the socket 3, it is possible to simply mount the light source unit 2 to the socket 3. In this case, since the release portions 45 and 46 release the engagement claws 52 and 53, respectively, it is possible to prevent a deviation of the inclination or the position of the light source unit 2 against the socket 3 by reliably releasing both the engagement claws 52 and 53 using both the release portions 45 and 46.

Next, a description will be made for the light emitting module according to a second embodiment of the present invention with reference to FIGS. 9 to 12. According to this embodiment, a holding portion 41 is provided on the mounting surface 31 of the socket 3, and an engagement portion 5 is provided on the mounting surface 21 of the light source unit 2.

Figure 9:
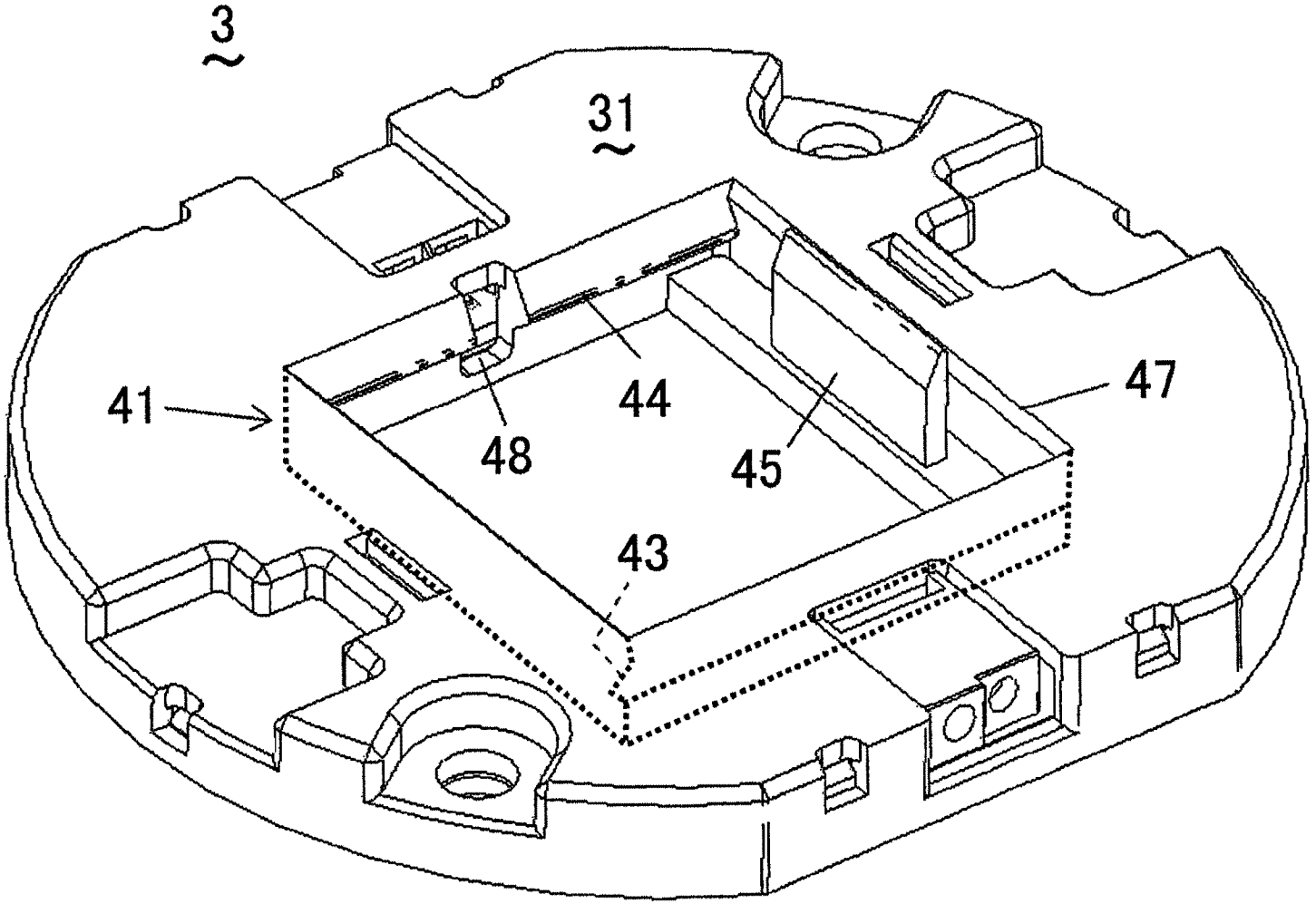
FIG. 9 is a perspective view illustrating the socket of the light emitting module according to a second embodiment of the present invention.

As illustrated in FIG. 9, the holding portion 41 of the socket 3 has a rectangular hollow 47 where the engagement portion 5 of the light source unit 2 is fitted, and a pair of holding claws 43 and 44 provided in the corresponding facing surfaces on the inner circumferential surface of the hollow 47. The holding claws 43 and 44 have convex or concave portion(s) having different numbers or relative positions in order to define an engagement direction with the engagement portion 5. In the illustrated example, a single concave portion 48 is provided in the holding claw 44, and neither convex nor concave portion is provided in the holding claw 43. In addition, the socket 3 has a release portion 45 erected from the mounting surface 31.

Figure 10:
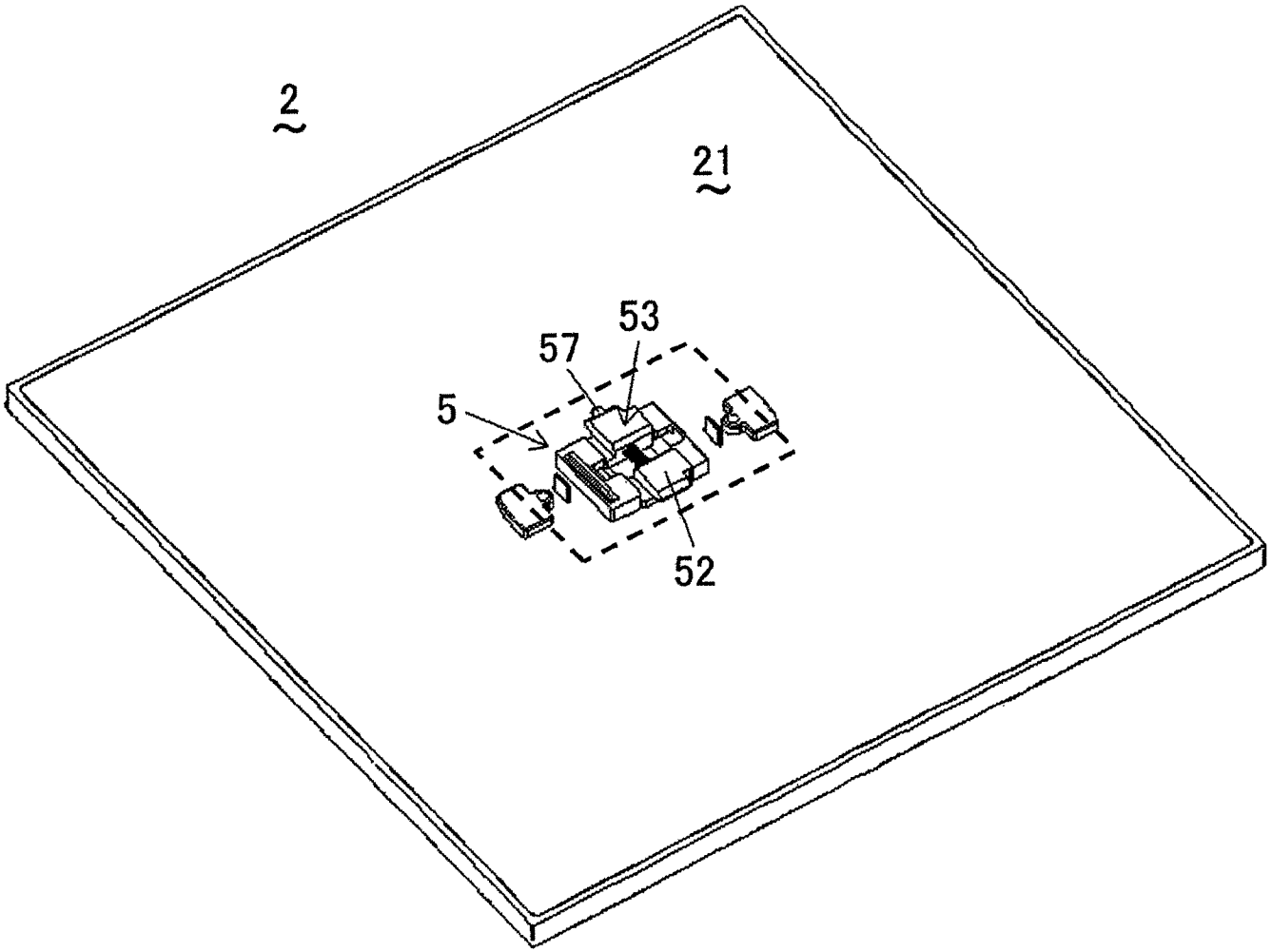
FIG. 10 is a perspective view illustrating a light source unit of the light emitting module.

As illustrated in FIG. 10, the engagement portion 5 of the light source unit 2 has engagement claws 52 and 53 in the center of the mounting surface 21. The engagement claw 53 has a convex portion 57 fitted to the concave portion 48 of the holding claw 44, and the engagement claw 52 has neither convex nor concave portion. In this configuration, although the engagement claw 53 can be engaged with the holding claw 44, it is difficult to engage the engagement claw 53 with the holding claw 43 because the convex portion 57 abuts on the holding claw 43. As a result, it is possible to mount the light source unit 2 to the socket 3 in a predetermined orientation.

Figure 11A:
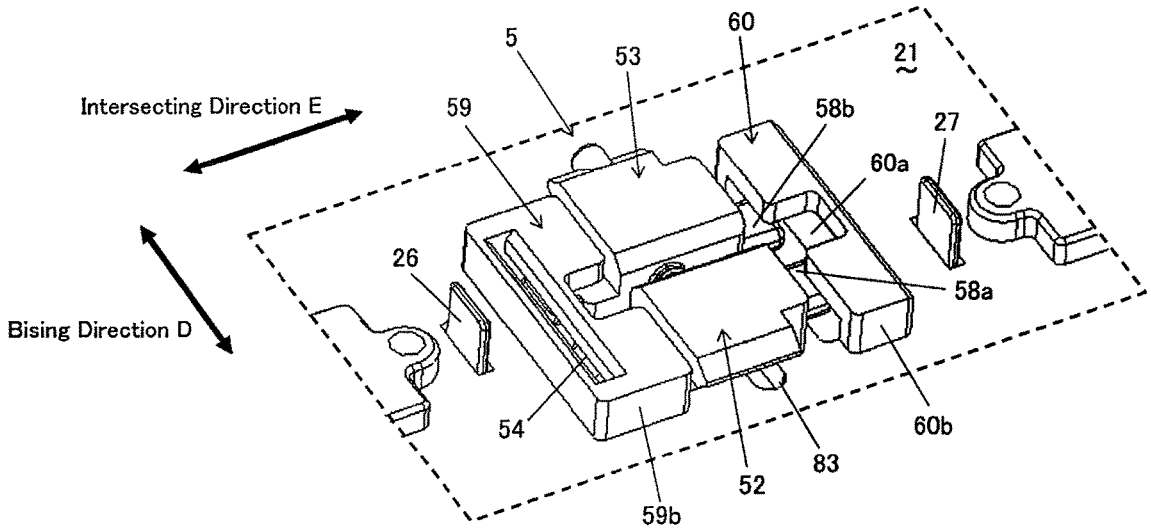
FIG. 11A is an enlarged view illustrating an area enveloped by the dotted line of FIG. 10.
Figure 11B:
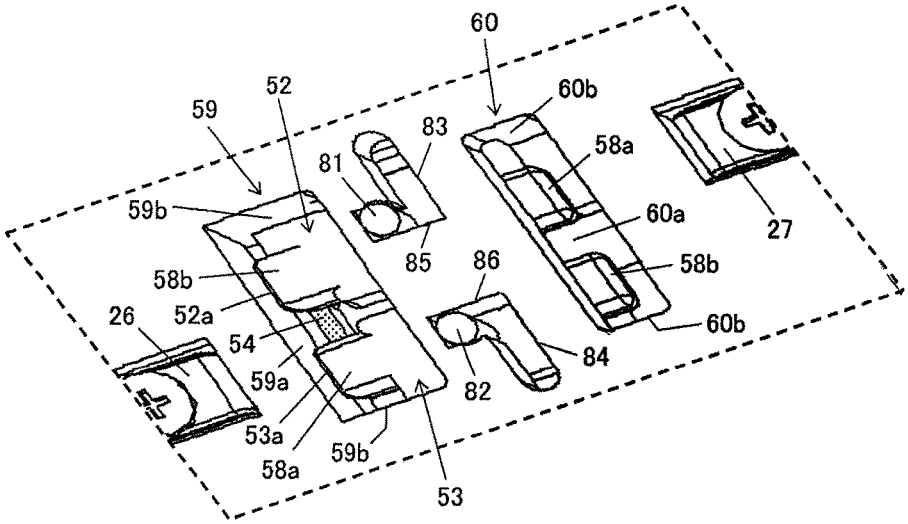
FIG. 11B is a perspective view illustrating the engagement portion of FIG. 11A as seen from a face opposite to the mounting surface.

FIG. 11A is a diagram illustrating the engagement portion 5 as seen from the mounting surface 21 side. FIG. 11B is a diagram illustrating the engagement portion 5 as seen from the rear side of the mounting surface 21. The engagement portion 5 has a pair of blades 58*a* and 58*b* extending from the engagement claws 52 and 53, respectively, along the intersecting direction E in parallel to the mounting surface 21, and a pair of stoppers 59 and 60 erected on the mounting surface 21 to restrict movement of the blades 58*a* and 58*b* in the biasing direction D. The stoppers 59 and 60 have sliding trenches 59*a* and 60*a*, respectively, for slidably housing the blades 58*a* and 58*b* along the biasing direction D, and a pair of walls 59*b* and 60*b* provided in both ends of the sliding trenches 59*a* and 60*a*, respectively, in the biasing direction D. In this configuration, the engagement claws 52 and 53 can move along the biasing direction D within a range of movement of the blades 58*a* and 58*b* inside the sliding trenches 59*a* and 60*a*. In addition, the engagement portion 5 further has a slot 54 (indicated by dots in FIG. 11B) provided on the upper surface of the stopper 59 to receive the inserted release portion 45 of the socket 3.

Figure 12:
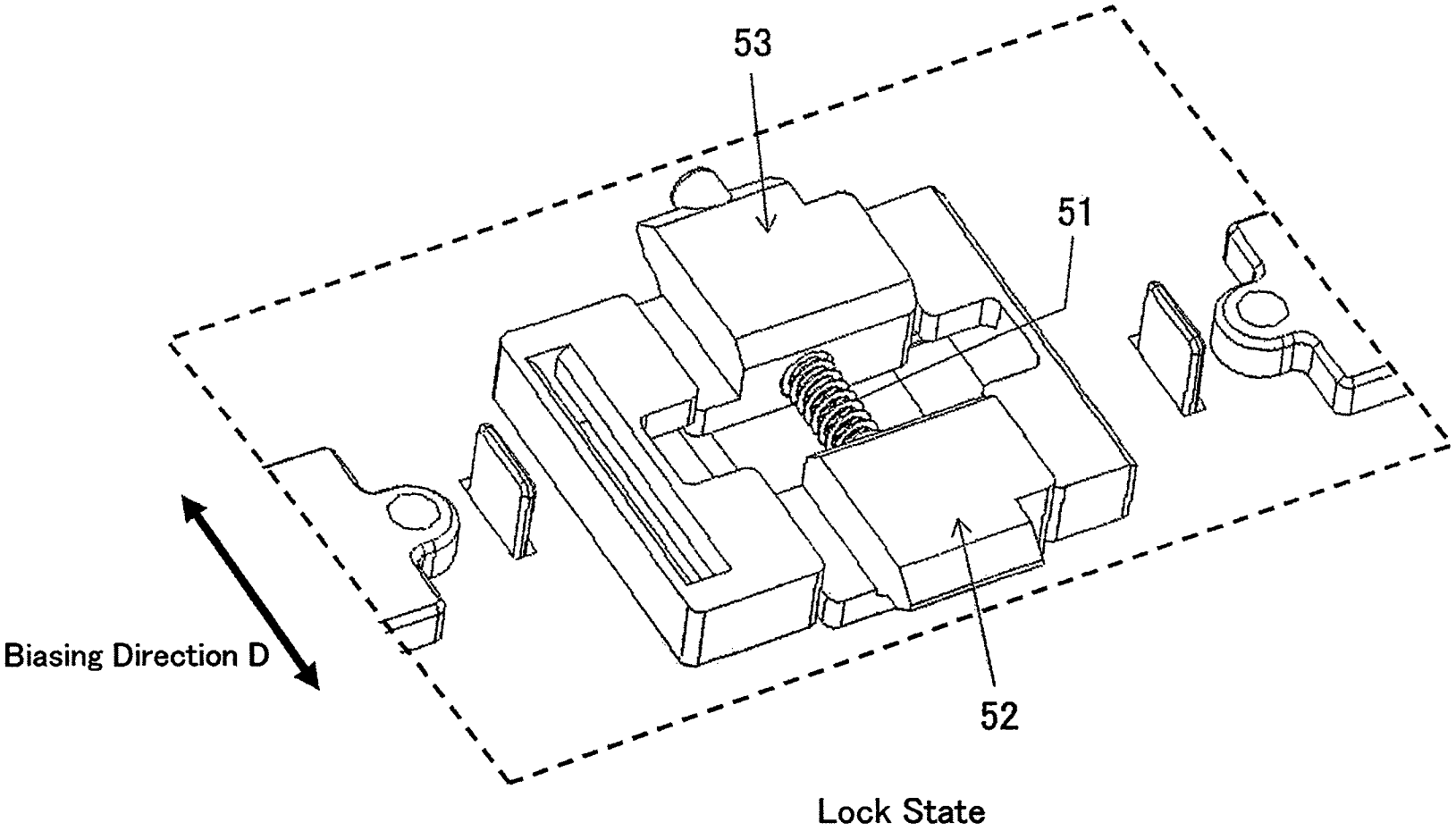
FIG. 12 is a perspective view illustrating the engagement portion having a locked state.

The protrusions 81 and 82 are provided to extend from the engagement claws 52 and 53, respectively, toward the mounting surface 21, and the intersecting trenches 85 and 86 are provided to extend in the same direction. In the set state in which the protrusions 81 and 82 are locked to the intersecting trenches 85 and 86, if the light source unit 2 is disposed in the mounting position to the socket 3, the release portion 45 of the socket 3 is inserted into the slot 54 of the light source unit 2. The release portion 45 inserted into the slot 54 abuts on the ends 52*a* and 53*a* of the engagement claws 52 and 53 and causes the engagement claws 52 and 53 to slide so as to move the protrusions 81 and 82 from the intersecting trenches 85 and 86 to the paralleled trenches 83 and 84. As the protrusions 81 and 82 arrive at the paralleled trenches 83 and 84, the engagement claws 52 and 53 are elastically biased oppositely to the biasing direction D by virtue of an elastic force of the spring 51 as illustrated in FIG. 12, so that the engagement claws 52 and 53 are positioned in the locked state in which they can be engaged with the holding claws 43 and 44 of the socket 3.

The light emitting module according to this embodiment also can have the same effects as those of the light emitting module 1 described above.

Figure 13B:
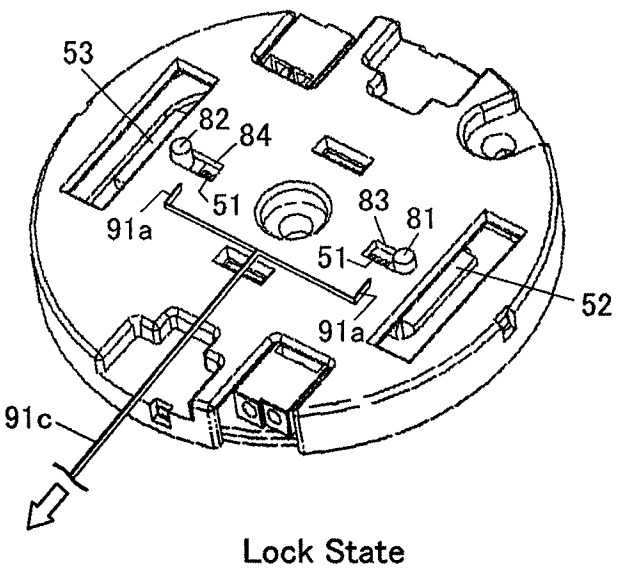
FIGS. 13A and 13B are diagrams illustrating operation of the light emitting module according to a third embodiment of the present invention when the engagement portion switches from the set state to the locked state.

Next, a description will be made for a light emitting module according to a third embodiment of the present invention with reference to FIGS. 13A and 13B. Compared to the light emitting module 1 described above, the light emitting module according to this embodiment has a holding tool 91 serving as the holding mechanism 8 without providing the intersecting trenches 85 and 86, the slots 54 and 55, and the release portions 45 and 46.

Figure 13A:
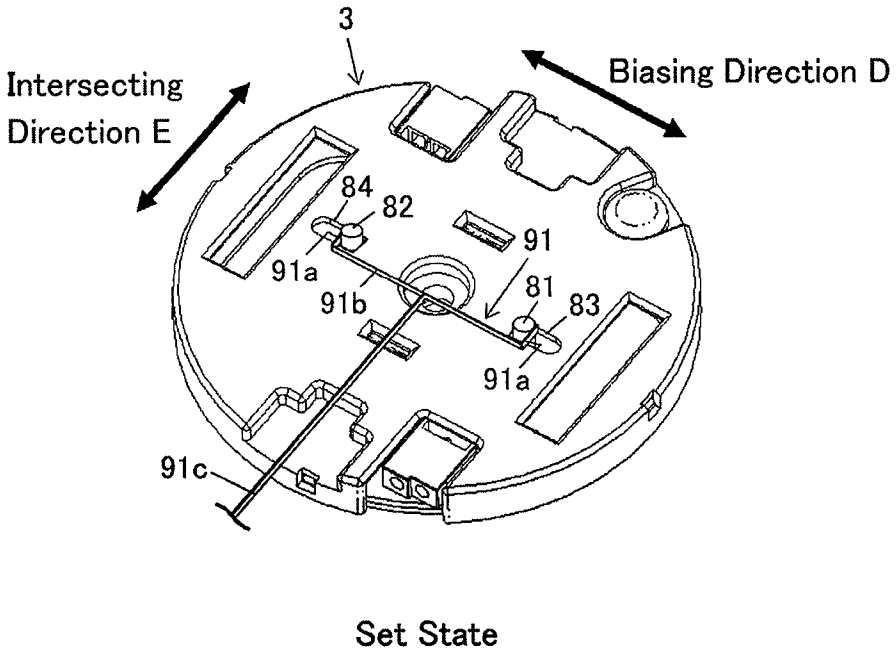

As illustrated in FIG. 13A, the holding tool 91 has a pair of abutments 91*a* abutting on outward ends of the protrusions 81 and 82 in the socket 3 along the biasing direction D, the protrusions 81 and 82 being arranged in the inward sides of the paralleled trenches 83 and 84 in the socket 3. In addition, the holding tool 91 has a link portion 91*b* that links one-directional ends of a pair of abutments 91*a* to each other, and a grip portion 91*c* extending in parallel to the intersecting direction E oppositely to an extending direction of a pair of abutments 91*a* from the center of the link portion 91*b*. The grip portion 91*c* is configured to have a length such that its end protrudes to the outside of the light emitting module.

In order to mount the light source unit 2 (not shown) to the socket 3 using the holding tool 91, first, the protrusions 81 and 82 arranged in the inward sides of the paralleled trenches 83 and 84 in the socket 3 are interposed and held by a pair of abutments 91*a*. This state is defined as the set state. Then, in this set state, the light source unit 2 is disposed in the mounting position to the socket 3, and then, the holding tool 91 is pulled outward in the socket 3 by gripping the grip portion 91*c* as illustrated in FIG. 13B. In this way, the abutments 91*a* are separated from the protrusions 81 and 82, and the protrusions 81 and 82 move to the outward sides of the paralleled trenches 83 and 84 in the socket 3 by virtue of an elastic force of the spring 51, so that the engagement claws 52 and 53 are positioned in the locked state in which they can be engaged with the holding claws 43 and 44 (not shown).

Figure 14B:
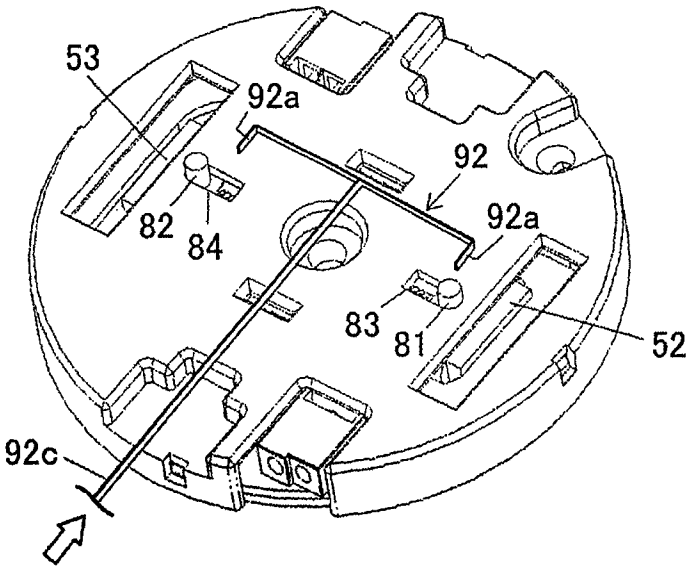
FIGS. 14A and 14B are diagrams illustrating operation of the light emitting module according to a modification of the embodiment when the engagement portion switches from the set state to the locked state.

Next, a description will be made for a light emitting module according to a modification of this embodiment with reference to FIGS. 14A and 14B. This light emitting module has a holding tool 92 having a structure different from that of the aforementioned holding tool 91. In the holding tool 91, a pair of abutments 91*a* and the grip portion 91*c* extend oppositely to each other. In comparison, in the holding tool 92, a pair of abutments 92*a* and the grip portion 92*c* extend in the same direction.

Figure 14A:
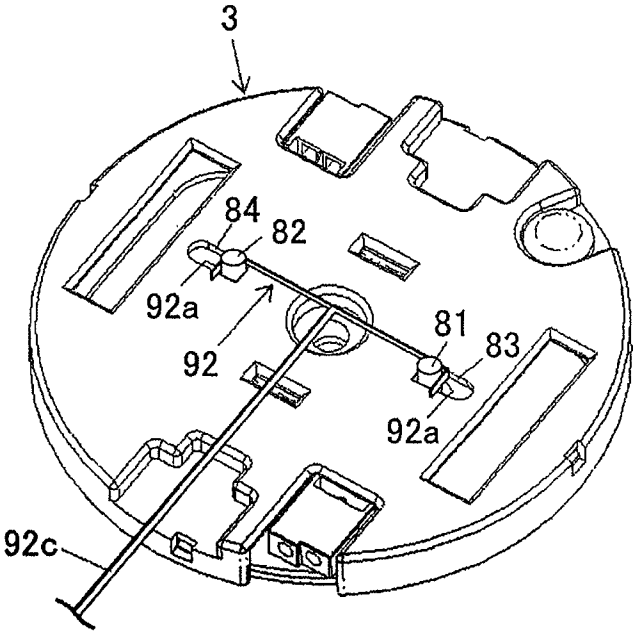

In order to mount the light source unit 2 (not shown) to the socket 3 using the holding tool 92, first, similar to the case of the holding tool 91, the protrusions 81 and 82 arranged in the inward sides of the paralleled trenches 83 and 84 in the socket 3 are interposed and held by a pair of abutments 92*a* as illustrated in FIG. 14A. Then, in this set state, the light source unit 2 is disposed in the mounting position to the socket 3, and then, the holding tool 92 is inserted into the inward side of the socket 3 by gripping the grip portion 92*c* as illustrated in FIG. 14B. As a result, the protrusions 81 and 82 released from a pair of abutments 92*a* move to the outward sides of the paralleled trenches 83 and 84 in the socket 3 and are positioned in the locked state in which the engagement claws 52 and 53 can be engaged with the holding claws 43 and 44 (not shown).

As described above, using the light emitting module according to this embodiment and the modification thereof, it is possible to hold and release the engagement claws 52 and 53 even without providing the intersecting trenches 85 and 86, the slots 54 and 55, and the release portions 45 and 46 and obtain the same effects as those of the light emitting module 1 described above.

Next, a description will be made for a light emitting module according to a fourth embodiment of the present invention with reference to FIGS. 15 to 20. In this light emitting module, configurations of the holding mechanism 8 and the release portions 45 and 46 are different from those of the light emitting module 1 described above. A part of the holding mechanism 8 is provided in the engagement claws 52 and 53, and the remaining part of the holding mechanism 8 is provided in the socket body 71 of the socket 3. The release portions 45 and 46 are provided on the mounting surface 21 of the light source unit 2.

Figure 15:
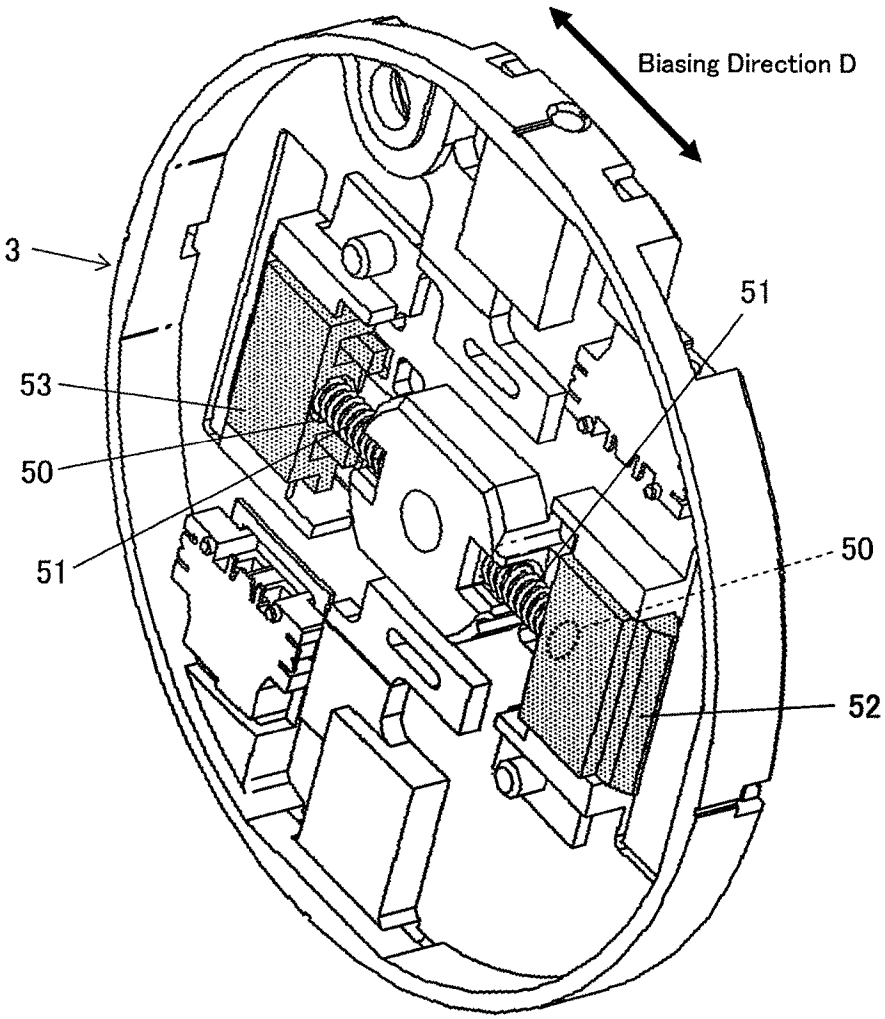
FIG. 15 is a perspective view illustrating a socket of a light emitting module according to a fourth embodiment of the present invention.

As illustrated in FIG. 15, each of the engagement claws 52 and 53 (indicated by dots) has a spring inlet 50 for receiving an end of the inserted spring 51 in the center of the lateral surface of the inward side of the light emitting module and is biased in the biasing direction D outward from the center of the socket 3. It is noted that the circuit board 6 and the socket cover 72 are not illustrated for simplicity purposes in FIG. 15.

Figure 16:
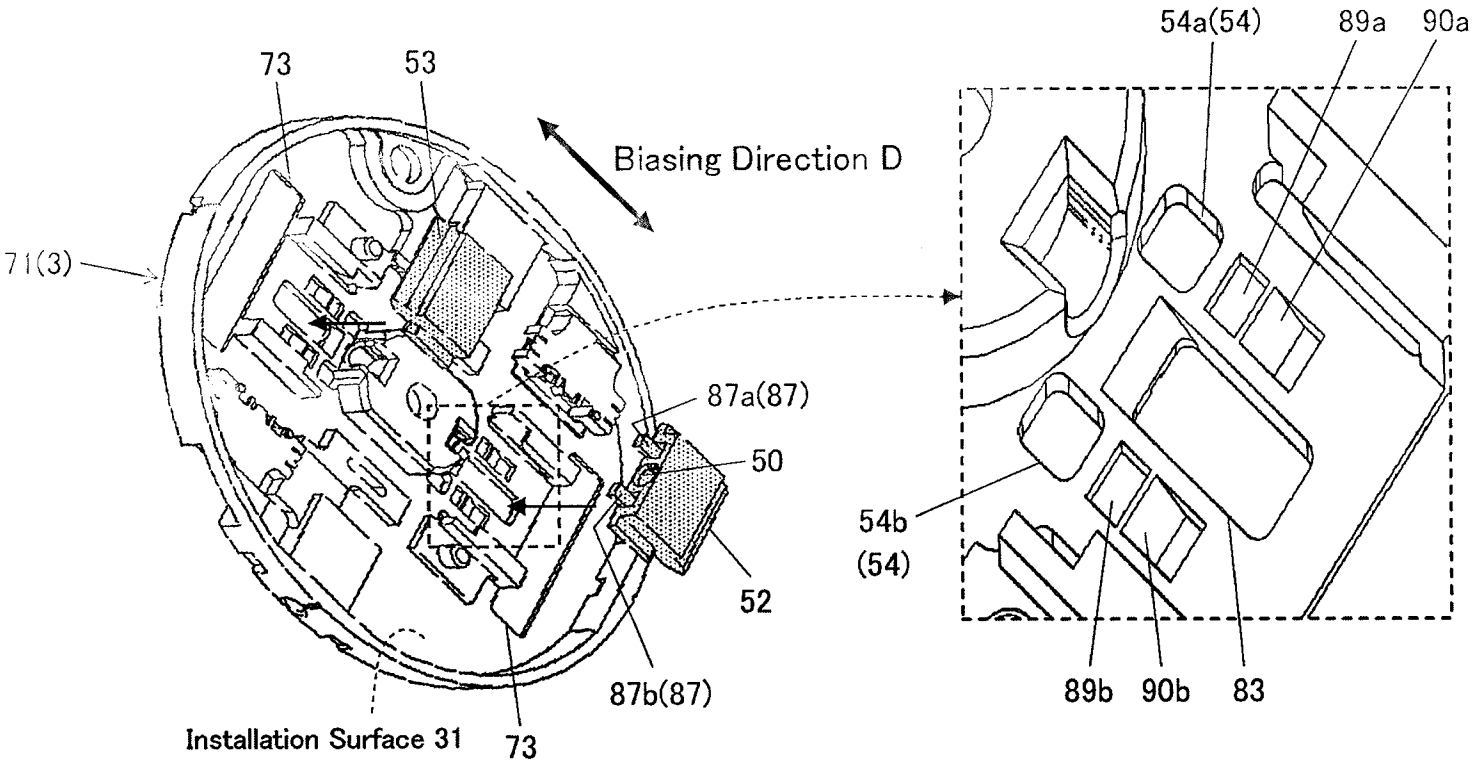
FIG. 16 is a perspective view illustrating a socket body of the socket and a partially enlarged view thereof.
Figure 17:
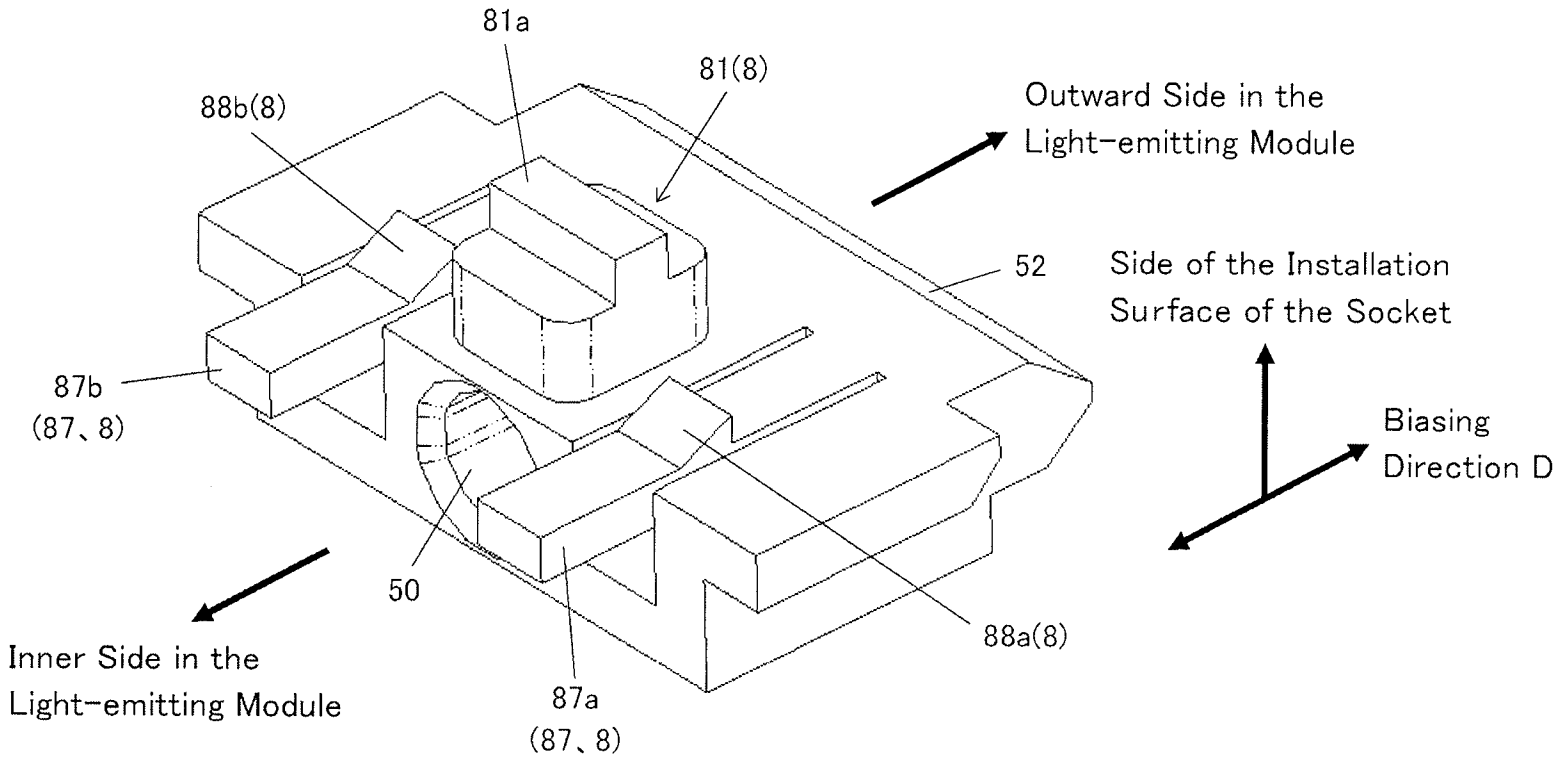
FIG. 17 is a perspective view illustrating an engagement claw of the socket.

As illustrated in FIGS. 16 and 17, the holding mechanism 8 has a protrusion 81 extending from the engagement claw 52 toward the mounting surface 31 of the socket 3 perpendicularly to the mounting surface 31 (refer to FIG. 17), and a paralleled trench 83 provided in the socket body 71 to receive the inserted protrusion 81 (refer to FIG. 16). The protrusion 81 has a step 81*a* in order to facilitate user's fingering when a user grips and manipulates the protrusion 81. The paralleled trench 83 is provided in parallel to the biasing direction D. In addition, the holding mechanism 8 has an extension 87 extending from the engagement claw 52 inward in the light emitting module along the biasing direction D (in parallel to the paralleled trench 83). The extension 87 is provided such that its outward end in the light emitting module is cantilevered against the engagement claw 52 such that its inward end in the light emitting module can be elastically pressed oppositely to the mounting surface 31 of the socket 3. In the illustrated example, a pair of extensions 87*a* and 87*b* are provided such that the spring inlet 50 is interposed between the extensions 87*a* and 87*b*.

The holding mechanism 8 has hooking claws 88*a* and 88*b* protruding from the basal portions of the extensions 87*a* and 87*b* toward the mounting surface 31 of the socket 3 (refer to FIG. 17), and hooking concave portions 89*a* and 89*b* provided in an inner surface of the socket body 71 and engaged with the hooking claws 88*a* and 88*b* (refer to FIG. 16). The hooking concave portions 89*a* and 89*b* are provided such that the engagement claw 52 is arranged inward more than a portion of the socket 3 directly under the hole 73 in the light emitting module so as not to be engaged with the holding portion 41 of the light source unit 2 (this state is the set state). Furthermore, the holding mechanism 8 has housing concave portions 90*a* and 90*b* provided outward more than the hooking concave portions 89*a* and 89*b* in the light emitting module along the biasing direction D to house the hooking claws 88*a* and 88*b*. The housing concave portions 90*a* and 90*b* are provided such that the engagement claw 52 is arranged directly under the hole 73 so as to be engaged with the holding portion 41 of the light source unit 2 when the hooking claws 88*a* and 88*b* are housed (this state is the locked state).

The slot 54 for receiving the inserted release portion 45 of the light source unit 2 (as described below) includes slots 54*a* and 54*b* provided inward more than the hooking concave portions 89*a* and 89*b* in the light emitting module along the biasing direction D. The slots 54*a* and 54*b* are provided such that ends of the extensions 87*a* and 87*b* are arranged directly under the slots 54*a* and 54*b* when the engagement claw 52 is positioned in the set state, whereas the ends of the extensions 87*a* and 87*b* are arranged outward more than the slots 54*a* and 54*b* in the light emitting module when the engagement claw 52 is positioned in the locked state. It is noted that, although the description has been made for the holding mechanism 8 corresponding to the engagement claw 52, the aforementioned configuration can apply similarly to the holding mechanism 8 corresponding to the engagement claw 53.

Figure 18:
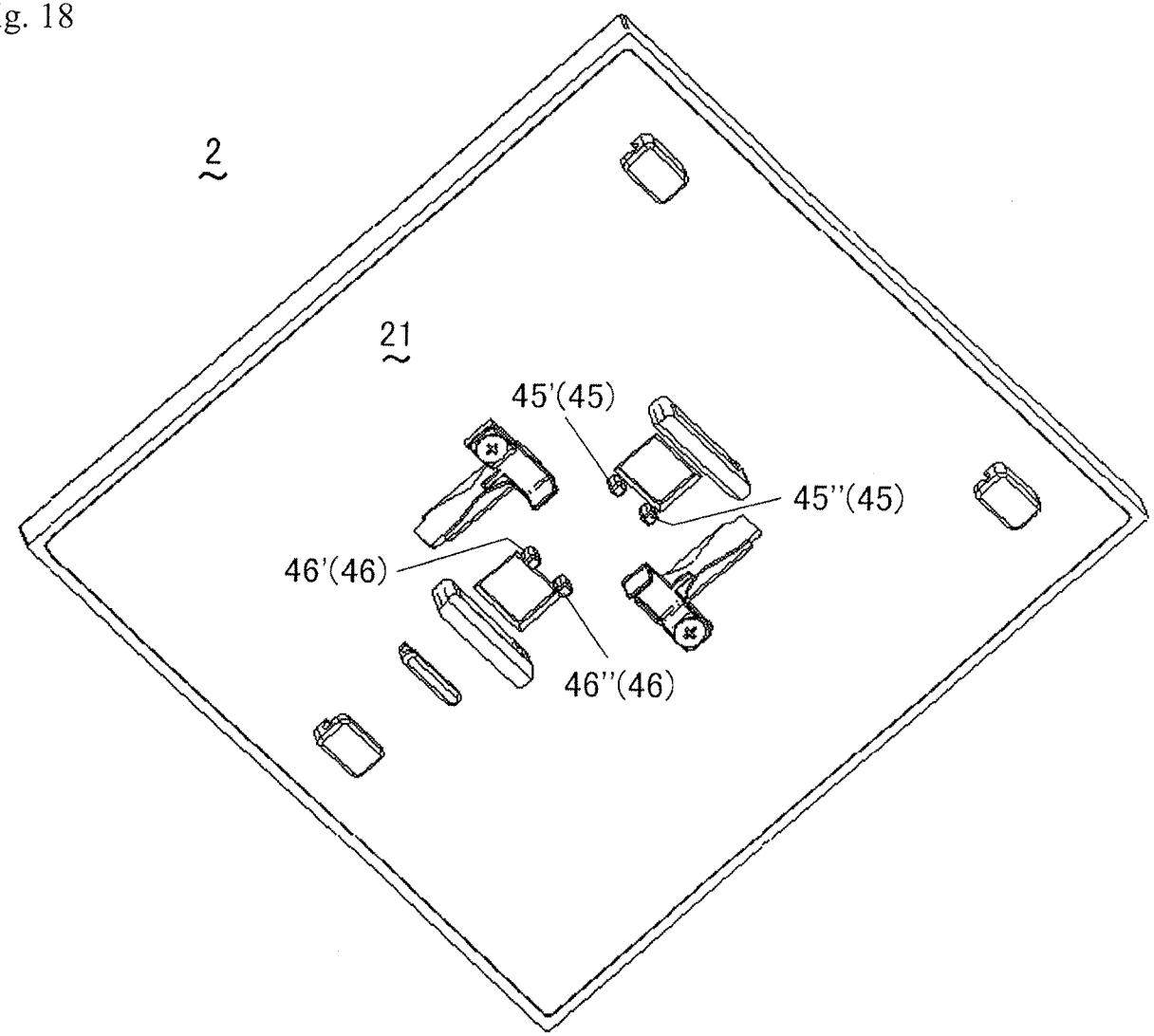
FIG. 18 is a perspective view illustrating a light source unit of the light emitting module.

As illustrated in FIG. 18, the release portion 45 includes release portions 45' and 45" positioned to match the slots 54*a* and 54*b*, respectively, on the mounting surface 21 of the light source unit 2. The release portions 45' and 45" are inserted into the slots 54*a* and 54*b* of the socket 3 and abut on the ends of the extensions 87*a* and 87*b* when the light source unit 2 having the engagement claw 52 positioned in the set state is mounted to the socket 3. The release portion 46 for the engagement claw 53 includes release portions 46' and 46".

Figure 19A:
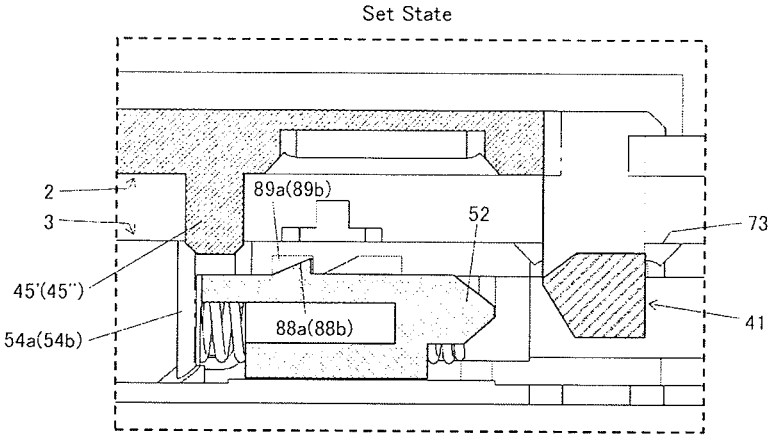
FIGS. 19A to 19C are diagrams illustrating operation when the light source unit is mounted to the socket.
Figure 19B:
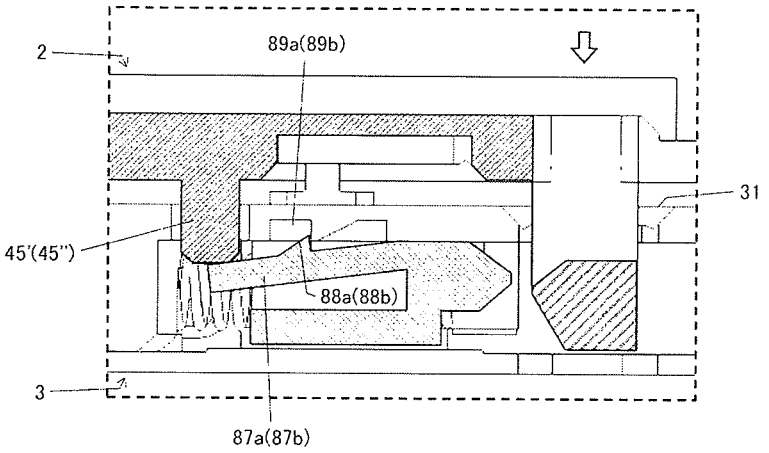
Figure 19C:
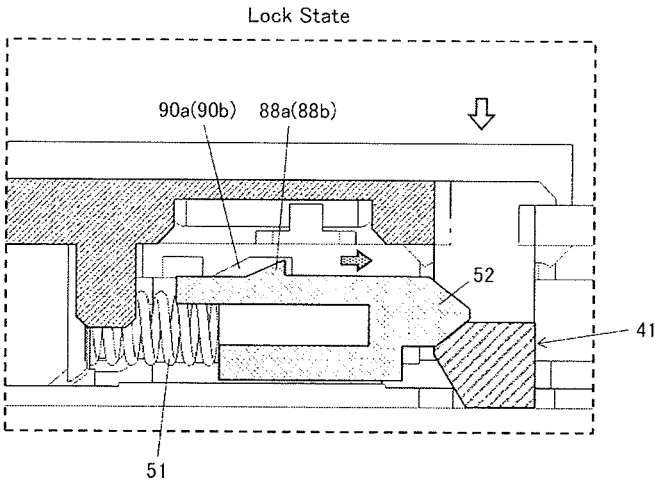

A description will now be made, with reference to FIGS. 19A to 19C, for operation of the light emitting module configured as described above when the light source unit 2 is mounted to the socket 3. First, as illustrated in FIG. 19A, in the socket 3, the engagement claw 52 is positioned in the set state by engaging the hooking claw 88*a* (or 88*b*) to the hooking concave portion 89*a* (or 89*b*). Then, the light source unit 2 is caused to approach the socket 3 such that the release portion 45' (or 45") and the holding portion 41 of the light source unit 2 can be inserted into the slot 54*a* (or 54*b*) and the hole 73, respectively, of the socket 3. Then, as illustrated in FIG. 19B, the release portion 45' (or 45") presses the end of the extension 87*a* (or 87*b*) oppositely to the mounting surface 31 of the socket 3 so as to release engagement between the hooking claw 88*a* (or 88*b*) and the hooking concave portion 89*a* (or 89*b*). As a result, as illustrated in FIG. 19C, the engagement claw 52 is biased toward the holding portion 41 by the spring 51 and is engaged with the holding portion 41 so as to be positioned in the locked state. Accordingly, the light source unit 2 is mounted to the socket 3. In this case, the hooking claw 88*a* (or 88*b*) is housed in the housing concave portion 90*a* (or 90*b*).

Figure 20A:
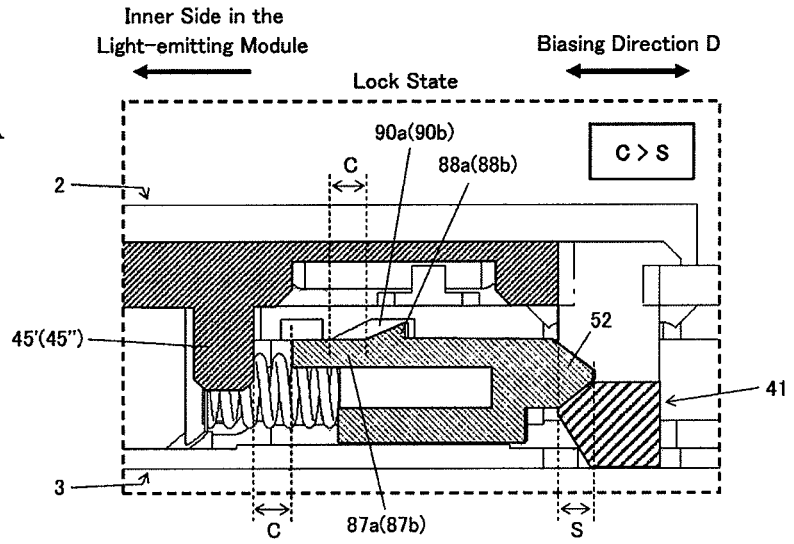
FIGS. 20A to 20C are diagrams illustrating operation when the light source unit is removed from the socket.
Figure 20B:
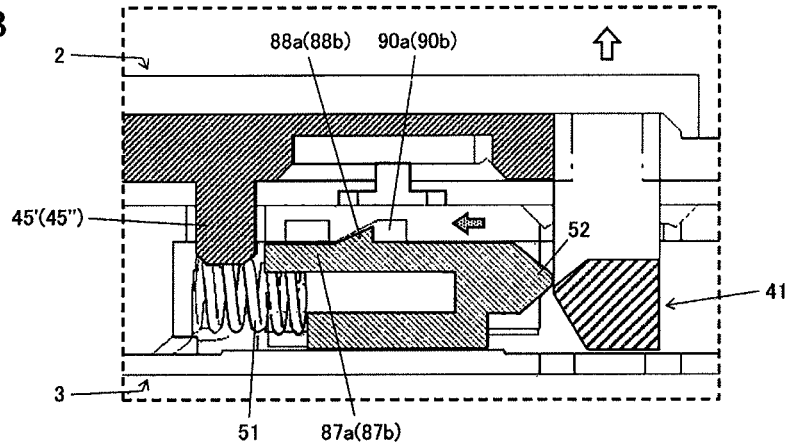
Figure 20C:
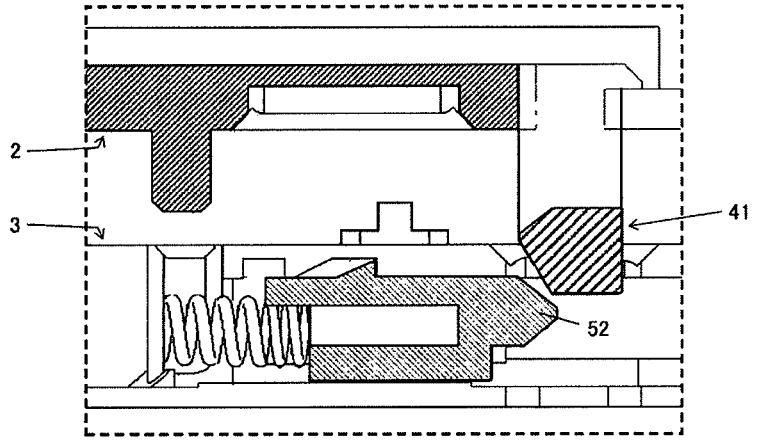
Figure 21:
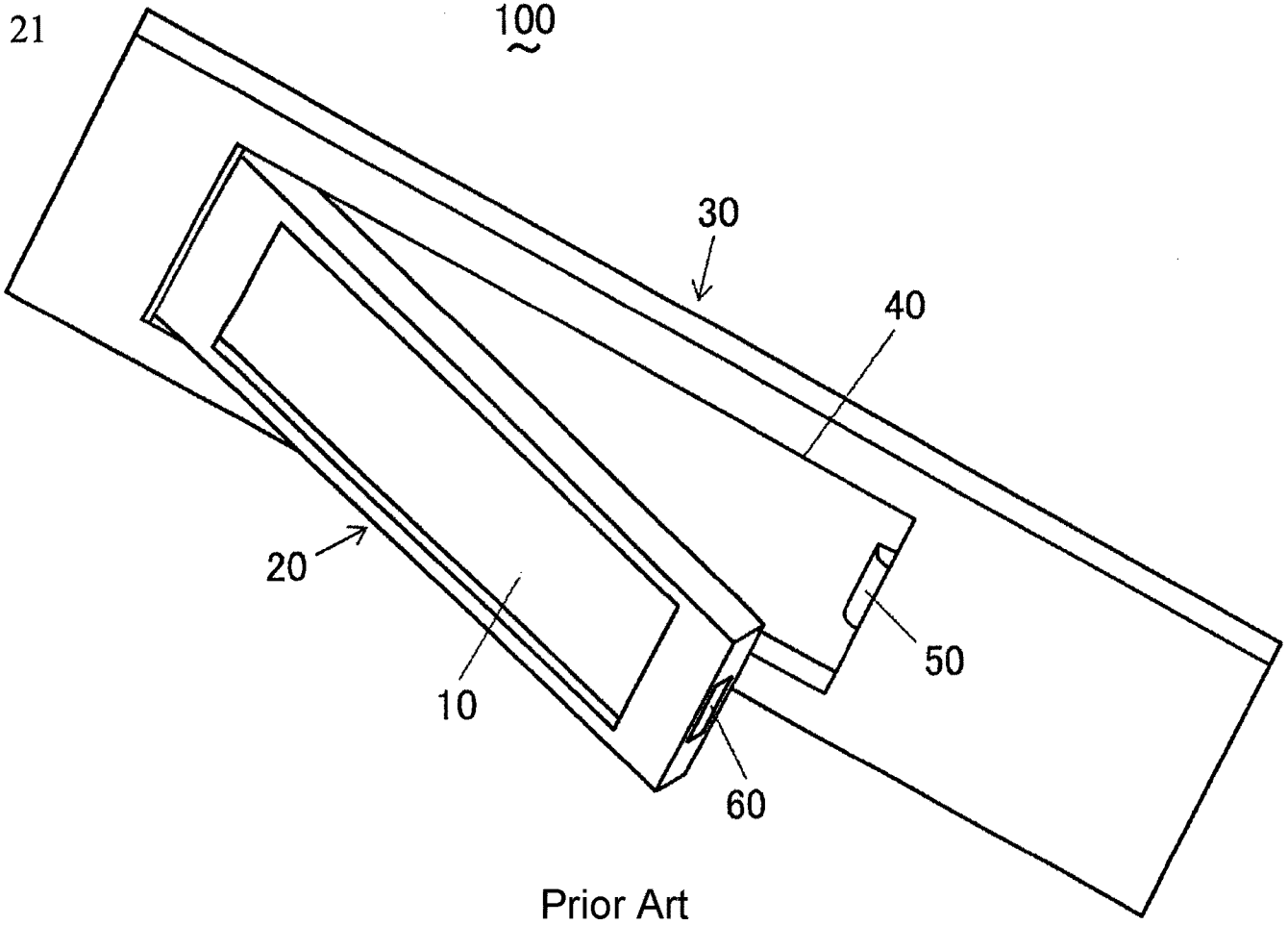
Prior Art Fig. 21
FIG. 21 is a perspective view illustrating a light emitting module of the prior art.

Next, a description will be made, with reference to FIGS. 20A to 20C, for operation of the light emitting module when the light source unit 2 is separated from the socket 3. FIG. 20A illustrates a state that the light source unit 2 is mounted to the socket 3 (i.e., the locked state). In this case, a clearance C is provided between the end of the extension 87*a* (or 87*b*) and the release portion 45' (or 45"). The clearance C is also provided between the hooking claw 88*a* (or 88*b*) and the inward end of the housing concave portion 90*a* (or 90*b*) in the light emitting module such that the clearance C is larger than a slide amount S of the engagement claw 52 for sliding inward in the light emitting module when the engagement claw 52 is separated from the holding portion 41. If the light source unit 2 is pulled and separated from the socket 3 from the state of FIG. 20A as illustrated in FIG. 20B, the engagement claw 52 slides inward in the light emitting module resisting to the elastic force of the spring 51 so as to be separated from the holding portion 41. In this case, since the clearance C is larger than the slide amount S, the end of the extension 87*a* (or 87*b*) and the hooking claw 88*a* (or 88*b*) do not make contact with the release portion 45' (or 45") and the housing concave portion 90*a* (or 90*b*), respectively. Then, as illustrated in FIG. 20C, as the light source unit 2 is further pulled, the engagement claw 52 is perfectly separated from the holding portion 41, and the light source unit 2 is removed from the socket 3.

In this light emitting module, only a force of expanding or contracting the spring 51 along the biasing direction D is exerted to the spring 51 that biases the engagement claws 52 and 53, and no force is exerted in a direction intersecting with the biasing direction D. For this reason, it is possible to prevent torsion of the spring 51, and thus, prevent erroneous operation of the engagement claws 52 and 53 that may occur due to torsion of the spring 51. Therefore, it is possible to improve reliability of the light emitting module. In addition, since the housing concave portions 90*a* and 90*b* are provided, a stress is not consistently applied to the hooking claws 88*a* and 88*b* in the locked state, so that it is possible to prevent creep deformation of the hooking claws 88*a* and 88*b*. Furthermore, holding of the engagement claw 52 is not released if both the extensions 87*a* and 87*b* are pressed simultaneously using the release portions 45' and 45". For this reason, if the light source unit 2 does not appropriately abut on the mounting surface 31 of the socket 3, the light source unit 2 is not mounted to the socket 3. Therefore, it is possible to prevent erroneous mounting of the light source unit 2.

It is noted that the light emitting module and the illuminating instrument according to the present invention are not limited to the aforementioned embodiments and modifications thereof, and may change in various forms. For example, although each of the engagement claws is biased from the inward side to the outward side in the light emitting module, each of the engagement claws may be biased from the outward side to the inward side in the light emitting module. In addition, the holding mechanism may have other configurations without limiting to the aforementioned one. For example, the engagement claws and the holding portion may be engaged with each other by fixing the adjacent engagement claws with each other using strings and cutting out the strings.

REFERENCE SIGNS AND NUMERALS

1 light emitting module
2 light source unit
21 mounting surface (of light source unit)
26, 27 feeding terminal
3 socket
31 mounting surface (of socket)
41, 42 holding portion
45, 45', 45", 46, 46', 46" release portion
45*a* surface of release portion facing a pair of engagement claws
45*b* basal portion (of surface of release portion facing a pair of engagement claws)
45*c* apex portion (of surface of release portion facing a pair of engagement claws)
48 concave portion
5 engagement portion
52, 53 engagement claw
52*a*, 53*a* ends of engagement claw in intersecting direction
56 mark
57 convex portion
61 terminal receptacle
75, 76, 77, 78 socket fixture
8 holding mechanism
81, 82 protrusion
83, 84 paralleled trench
85, 86 intersecting trench
87, 87*a*, 87*b* extension
88*a*, 88*b* hooking claw
89*a*, 89*b* hooking concave portion
90*a*, 90*b* housing concave portion
D biasing direction
E intersecting direction

The invention claimed is:

1. A light emitting module comprising:
a flat light source unit; and
a flat socket where the light source unit is detachably mounted,
any one of the light source unit and the socket having a holding portion for holding the other one in a center of a mounting surface facing the other one,
the other one having an engagement portion for engagement with the holding portion,
the engagement portion having a pair of engagement claws biased in parallel to the mounting surface movably oppositely to each other and engaged with the holding portion, and a holding mechanism that holds the pair of engagement claws resisting to a biasing force so as to prevent the pair of engagement claws from being engaged with the holding portion,
the light source unit being disposed in a mounting position to the socket so that the pair of engagement claws and the holding portion are engaged with each other when the pair of engagement claws held by the holding mechanism is released.

2. The light emitting module according to claim 1, wherein the holding portion has a release portion that releases the pair of engagement claws held by the holding mechanism when the light source unit is disposed in the mounting position to the socket.

3. The light emitting module according to claim 2, wherein the release portion releases the pair of engagement claws held by the holding mechanism when the light source unit and the socket approach each other by causing corresponding mounting surfaces to face each other, and the light source unit is disposed in the mounting position to the socket.

4. The light emitting module according to claim 3, wherein a plurality of the release portions are erected on the mounting surface, at least one of the release portions releases one of the pair of engagement claws held by the holding mechanism, and the other release portion releases the other engagement claw held by the holding mechanism.

5. The light emitting module according to claim 2, wherein each of the pair of engagement claws is movable in an intersecting direction intersecting with a corresponding biasing direction in parallel to the mounting surface, and the holding mechanism holds the pair of engagement claws by moving the pair of engagement claws in the intersecting direction.

6. The light emitting module according to claim 5, wherein the holding mechanism has a pair of protrusions extending from the pair of engagement claws, respectively, perpendicularly to the mounting surface, a pair of paralleled trenches provided in parallel to the biasing direction to receive the pair of protrusions when they are inserted, respectively, and a pair of intersecting trenches provided to connect with inward ends of the pair of paralleled trenches, respectively, in the light emitting module and extend along the intersecting direction.

7. The light emitting module according to claim 6, wherein the pair of protrusions are arranged in a point symmetrical manner with respect to a center of the light emitting module such that the pair of engagement claws are held by the holding mechanism when the pair of protrusions move oppositely to each other.

8. The light emitting module according to claim 6, wherein the release portions abut on ends of the intersecting direction of the pair of engagement claws held by the holding mechanism when the light source unit is disposed in the mounting position to the socket, and surfaces of the release portions abutting on the pair of engagement claws from a basal portion to an apex portion have a tapered shape such that they are inclined from an inward side to an outward side of the light emitting module.

9. The light emitting module according to claim 2, wherein each of the pair of engagement claws is movable in parallel to the mounting surface and the corresponding biasing direction, and the holding mechanism holds the pair of engagement claws while the pair of engagement claws is adjacent to each other.

10. The light emitting module according to claim 9, wherein the holding mechanism has a pair of protrusions extending from the pair of engagement claws, respectively, perpendicularly to the mounting surface, a pair of paralleled trenches provided in parallel to the biasing direction to receive the pair of protrusions, respectively, when they are inserted, an elastic extension extending from each of the pair of engagement claws in parallel to the pair of paralleled trenches, a hooking claw protruding from the basal portion of the extension toward the mounting surface, and a hooking concave portion engaged with the hooking claw while the pair of engagement claws is adjacent to each other.

11. The light emitting module according to claim 10, wherein the release portion presses an end of the extension oppositely to the mounting surface to release engagement between the hooking claw and the hooking concave portion when the light source unit is disposed in the mounting position to the socket while the pair of engagement claws are adjacent to each other using the holding mechanism.

12. The light emitting module according to claim 10, wherein the holding mechanism further has a housing concave portion for housing the hooking claw, the housing concave portion being arranged outward more than the hooking concave portion in the light emitting module along the biasing direction, and the housing concave portion houses the hooking claw when engagement between the hooking claw and the hooking concave portion is released.

13. The light emitting module according to claim 1, wherein the engagement portion has a mark indicating a holding state of the pair of engagement claws held by the holding mechanism, the mark is exposed to the mounting surface side when the holding mechanism holds the pair of engagement claws, and the mark is concealed by the pair of engagement claws so as not to be exposed to the mounting surface side when the pair of engagement claws held by the holding mechanism is released.

14. The light emitting module according to claim 1, wherein the socket has a plurality of socket fixtures where screws for fixing the socket to an application surface are inserted, and one of the plurality of socket fixtures is provided in the center of the mounting surface.

15. The light emitting module according to claim 1, wherein each of the pair of engagement claws has convex or concave portions having different numbers or relative positions, and the holding portion has concave or convex portions fitted to the convex or concave portions of the engagement claws.

16. The light emitting module according to claim 1, wherein the light source unit has a pair of feeding terminals for feeding the light source unit on the mounting surface, the socket has a pair of terminal receptacles for receiving the pair of feeding terminals, respectively, and the pair of feeding terminals is electrically connected to the pair of terminal receptacles, respectively, when the light source unit is mounted to the socket.

17. An illuminating instrument comprising the light emitting module according to claim 1.

* * * * *